US007245871B2

(12) United States Patent
Kasahara

(10) Patent No.: US 7,245,871 B2
(45) Date of Patent: Jul. 17, 2007

(54) IMAGE FORMING SYSTEM HAVING SWITCHING SECTION FOR STACKERS AND IMAGE FORMING METHOD THEREOF

(75) Inventor: Seitaro Kasahara, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 291 days.

(21) Appl. No.: 10/946,964

(22) Filed: Sep. 21, 2004

(65) Prior Publication Data

US 2005/0220475 A1 Oct. 6, 2005

(30) Foreign Application Priority Data

Mar. 31, 2004 (JP) ..... 2004-106964

(51) Int. Cl.
*G03G 15/00* (2006.01)

(52) U.S. Cl. ..... 399/405; 271/290; 399/403

(58) Field of Classification Search ..... 399/82, 399/85, 405, 407, 403; 271/288, 290, 298, 271/299

See application file for complete search history.

(56) References Cited

U.S. PATENT DOCUMENTS 4,012,032 A * 3/1977 Rogers ..... 271/290
4,201,464 A * 5/1980 Botte et al. ..... 399/382
4,211,483 A * 7/1980 Hannigan et al. ..... 399/85
4,530,593 A * 7/1985 Kasuya et al. ..... 399/403
5,013,027 A * 5/1991 Furukawa ..... 271/290
5,202,738 A * 4/1993 Braswell et al. ..... 399/364
5,204,728 A * 4/1993 Braswell ..... 399/75

* cited by examiner

*Primary Examiner*—Robert Beatty
(74) *Attorney, Agent, or Firm*—Squire, Sanders & Dempsey L.L.P.

(57) ABSTRACT

An image forming system including: an image forming section for forming an image on a paper; a transporting path for transporting the paper on which the image has been formed in the image forming section; a plurality of stackers for stacking the paper transported by the transporting path; a switching section for selecting and switching to, on a way of the transporting path, a transporting destination of the paper among the plurality of stackers; and a controller for controlling the image forming section and the switching section; wherein when transportation of papers, on which images have been formed, is switched from a first copy set to a second copy set, the controller controls the switching section to switch the transporting destination for the second copy set to another stacker within the plurality of stackers.

17 Claims, 15 Drawing Sheets

IMAGE FORMING SYSTEM HAVING SWITCHING SECTION FOR STACKERS AND IMAGE FORMING METHOD THEREOF

BACKGROUND OF THE INVENTION

The present invention relates to an image forming system and image forming method, and particularly to an image forming system having a plurality of stackers for stacking paper after image formation and an image forming method.

Image forming systems are known in which images are formed on a plurality of papers and then the plurality of papers are separated and stacked with every prescribed numbers of sheets. This type of image forming system comprises an image forming mechanism for recording images on paper and a stacking unit for separating the paper transported from the image forming mechanism into stacks of the prescribed number of sheets.

Patent document 1 discloses technology wherein a plurality of bin modules are used as the stacking unit and sheet material, which is the paper on which recording, has been done is stacked. According to this technology, the sheet materials on which recording has been done are stacked in a particular bin module, and when the number of sheet materials reaches the maximum sheet number for stacking in this module, a switch is made to another bin module and stacking is continued.

[Patent document 1: Japanese Patent Application Laid-Open No. HEI10-152260 publication]

In the technology described in Patent document 1, the sheet materials are stacked in one bin module until the maximum sheet number per stack is reached, but as a result, when an image forming job in which recording is done for large numbers of sheet or when a large copy set is done, even if the recorded sheet materials are for the same image forming job or copy set, recording may span more than one modules and the sheet materials are separated. Thus when book making or the like is being done, after separation of the sheet materials, in many cases the complicated operation of checking each page becomes necessary.

The present invention was conceived in view of the above described situation and an object thereof is to provide an image forming system in which even when an image forming job or copy set in which large volume image formation is performed, it is possible to ensure that paper for the image forming job unit or copy set unit are stacked in the same stacking unit, and an image forming method using this image forming system.

SUMMARY OF THE INVENTION

In accordance with one aspect of the invention, an image forming system is provided having an image forming section for forming images on sheets of paper, a transporting path for transporting the sheets of paper on which the images have been formed in the image forming section, and a plurality of stackers for stacking the sheets of paper transported by the transporting path, each stacker of the plurality of stackers being capable of sequentially stacking the paper up to a prescribed amount corresponding to a full capacity of the each stacker. The system further includes a switching section for selecting and switching to, on a way of the transporting path, a transporting destination of the paper among the plurality of stackers and a controller for detecting a projected number of sheets of paper needed for at least one of a next image forming job following a preceding image forming job and a next copy set following a preceding copy set, and for controlling the image forming section and the switching section, Moreover, the system includes a determination section for determining, in cases where the sheets of paper of at least one of the next image forming job and the next copy set are stacked in one stacker of the plurality of stackers, whether an amount of the sheets of paper to be stacked exceeds the prescribed amount for the one stacker, the amount of the sheets of paper to be stacked being calculated based on the projected number of sheets of paper and an amount of the sheets of paper already having been stacked. In cases where the determination section has determined that the amount of the sheets of paper to be stacked exceeds the prescribed amount, the controller controls the switching section to switch the transporting destination for the sheets of paper of at least one of the next image forming job and the next copy set to another stacker within the plurality of stackers.

In accordance with another aspect, an image forming method is provided for carrying out post-processing such that papers on which images have been formed is stacked in a plurality of stackers, each stacker of the plurality of stackers being capable of sequentially stacking the paper up to a prescribed amount corresponding to a full capacity of the each stacker. The image forming method can include the following steps: detecting a projected number of sheets of paper needed for at least one of a next image forming job following a preceding image forming job and a next copy set following a preceding copy set; determining, in cases where the sheets of paper of at least one of the next image forming job and the next copy set are stacked in one stacker of the plurality of stackers, whether an amount of the sheets of paper to be stacked exceeds the prescribed amount that is set for the one stacker, the amount of the sheets of paper to be stacked being calculated based on the projected number of sheets of paper and an amount of the sheets of paper already having been stacked; and switching the destination of the sheets of paper of at least one of the next image forming job and the next copy set to another stacker than the one stacker of the plurality of stackers, when the amount of sheets of paper to be stacked is determined to exceed the prescribed amount for the one stacker; wherein the step of switching is conducted when transporting of sheets of paper, on which images have been formed, is switched from transportation of the preceding copy set to transportation of the next copy set.

BEST MODES FOR CARRYING OUT THE INVENTION

Figure 1:
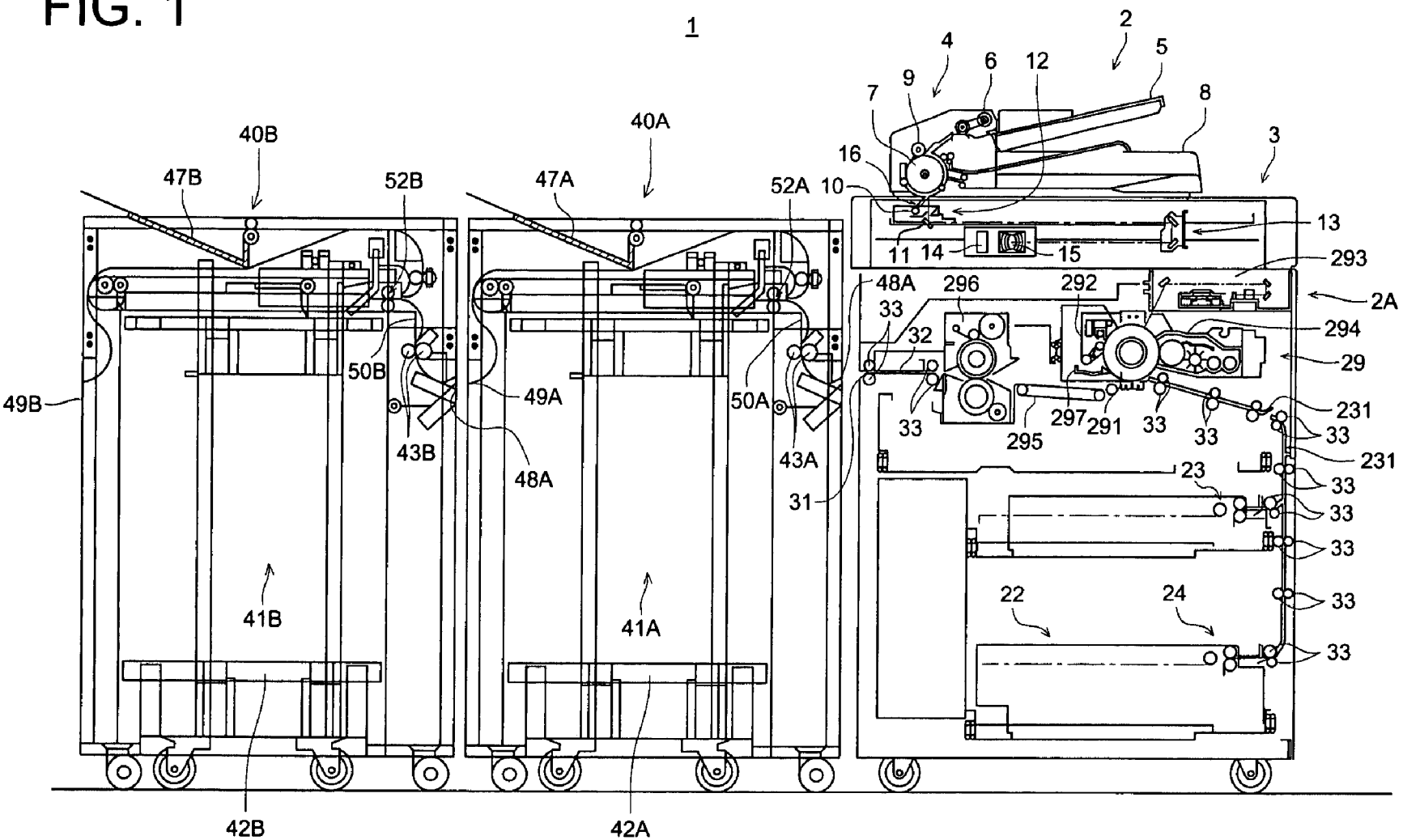
FIG. 1 shows the schematic structure of an image forming system of an embodiment of the present invention.
Figure 2:
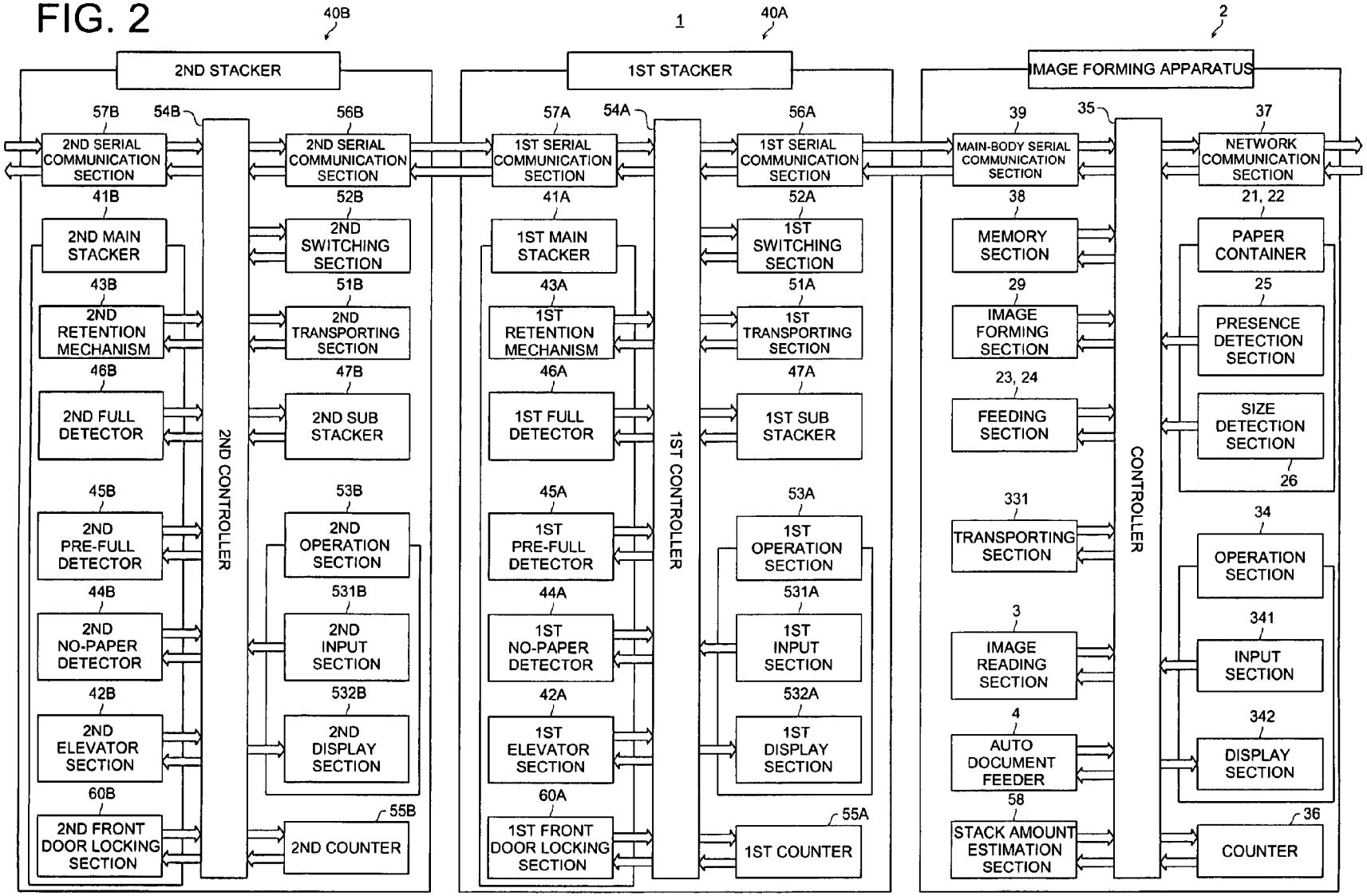
FIG. 2 is a block diagram of the main controlling structure of the image forming system.

The image formation system in these embodiments will be described in the following with reference to the drawings. However, the scope of this invention is not to be limited by these embodiments. FIG. 1 is a side view of the schematic structure of the image forming system, and FIG. 2 is a block diagram of the main controller structure of the image forming system.

As shown in FIG. 1, the image forming system 1 comprises an image forming apparatus 2 which forms images on paper P; a 1st stacker 40A which stacks paper P transported from the image forming apparatus 2; and a 2nd stacker 40B which is disposed at a different position than the 1st stacker 40A and stacks paper P transported via the 1st stacker 40A.

First the image forming apparatus 2 will be described.

The image formed in apparatus 2 comprises an image forming apparatus main-body 2A for forming images on paper P. An image reading section 3 for reading images formed on paper P from a document is provided on top of the image reading apparatus main-body 2A, and an auto document feeder 4 for automatically feeding documents to the image reading section 3 is provided on top of the image reading section 3.

The auto document feeder 4 has a document mounting table 5 for mounting documents, and a document feeding roller 6 for feeding one sheet of document at a time is provided at one end of the document mounting table 5. The lower side of the document mounting table 5 has a document support roller 7 which supports and rotates the document, and a document discharge table 8 for discharging documents read by the document reading section 3 is provided underneath the document mounting table 5. A document transport roller 9 for transporting the document fed from the document mounting table 5 to the upper circumferential surface of the document support roller 7 and discharging the document from the document discharge table 8 after it is transported along the circumferential surface of the document support roller 7, is provided inside the auto document feeder 4.

The image reading section 3 comprises a 1st mirror unit 12 in which a light source 10 for irradiating light onto the document and a mirror 11 for reflecting reflected light from the document are formed as one unit, and a second mirror unit 13 for further reflecting light from the 1st mirror unit 12. The mirror units 12 and 13 are disposed so as to be movable in the horizontal direction of FIG. 1. The image reading section 3 also comprises a CCD (Charge Coupled Diode) for example, and imaging element 14 which does photoelectric conversion of light. This imaging element 14 has lens 15 for focusing light from the 2nd mirror unit 13 in the focusing element on the front surface.

A slit 16 for irradiating light onto the document that is transported on the document support roller 7 is provided under the document support roller 7, and the image reading section 3 positions the 1st mirror unit 12 under the slit 16 and thereby reads images. The auto document feeder 4 is closeable with respect to the image reading section 3 and is formed of platen glass for mounting the document. The image reading section 3 performs scanning with the 1st and 2nd mirror units 12 and 13 and thereby reads the document mounted on the platen glass.

Two paper containers 21 and 22, which stack and store a plurality of papers P are provided as two upper and lower level containers at the inner lower section of the image forming main-body 2A. Feeding sections 23 and 24 respectively which feed papers P for image recording one sheet at a time from the paper containers 21 and 22 are provided at one upper side end. The paper containers 21 and 22 also have a presence detection section 25 for detecting the presence of paper P and a size detection section 26 for detecting paper size (see FIG. 2).

An image forming section 29 for forming images is provided above the paper containers 21 and 22. This image forming section 29 has a cylindrical photoreceptor drum 291, and this photoreceptor drum 291 is driven so as to be rotated in the clockwise direction of FIG. 1 by a drum driving mechanism (not shown).

A charger 292 is provided in the vicinity of the upper peripheral surface of the photoreceptor drum 291, and the charger 292 performs corona discharging of the surface of the photoreceptor drum 291 such that the surface of the photoreceptor drum 291 is evenly charged.

An exposure section 293 which has, for example, a laser diode as the exposure light source is disposed at the periphery of the photoreceptor drum 291, and is further downstream in the rotation direction of the photoreceptor drum 291 than the charger 292. The exposure section 293 carries out image exposure on the surface of the photoreceptor drum 291 based on image signals and as a result an electrostatic latent image is formed due to charge attenuation and reduction on the surface of the photoreceptor drum 291 which has been exposed.

A development section 294 is provided at the periphery of the photoreceptor drum 291, further downstream in the rotation direction of the photoreceptor drum than the exposure section 293, and the surface of the photoreceptor drum 291 is developed by the development section 294.

A transfer section 295 is provided at the periphery of the photoreceptor drum 291 further downstream in the rotation direction of the photoreceptor drum 291 than the developing section 294, and a transporting path is provided between the transfer section 295 and the photoreceptor drum 291 for transporting paper P. The transfer section 295 performs electrostatic transfer of a toner image to the paper P by subjecting the lower surface of photoreceptor drum 291 to corona discharging in a state in which the paper P is pressed thereto, and the paper P is removed from the photoreceptor drum 291 by removing the charge from the charged paper P.

A fixing section 296 is provided at the downstream side of the transporting path of the paper P with respect to the transfer section 295, and the toner image is fixed to the paper P by heating.

A cleaning section 297 for removing and cleaning the remaining toner which has been press-contacted to the surface of the photoreceptor drum 291 is provided further downstream in the rotation direction of the photoreceptor drum 291 than the transfer section 295.

The side portion of the image forming apparatus 2 has a discharge port 31 for discharging paper P on which images have been recorded.

A feeding transporting path 231 for transporting the paper P fed from the paper containers 21 and 22 to the image forming section 29, and a common transporting path 32 for transporting the paper P on which images have been formed in the image forming section 29 to the discharge exit 31 are provided in the image forming apparatus 2. The image forming apparatus 2 also has a transporting section 331 for transporting the paper P in the feeding transporting path 231 and the common transporting path 32 using a plurality of rollers 33 which are disposed at prescribed positions on the feeding transporting path 231 and the common transporting path 32.

As shown in FIG. 2, the image forming apparatus 2 has an operation section 34 for performing the operations of the image forming apparatus 2. The operation section 4 may be a touch panel type for example, and comprises an input section 341 for inputting various commands and a display section 342 for displaying image forming status such as paper size and the content various commands and the like.

In addition, the image forming apparatus 2 comprises a controller 35 for controlling the various drive sections. Feed sections 23 and 24; an image forming section 29; an input section 341; a display section 342; a transporting section 331; a counter 36 which counts the sheets for image formation; a network communication section 37 which is connected to various communication circuits; a memory section 38 for storing the image data input from the network communication section 37 and the count numbers from the counter 36, full-stack amount which is the prescribed stack amount set at each of the stackers, and control programs and the like; and a main-body serial communication section 39 which is connected to the 1st stacker 40A are electrically connected to the image forming apparatus 2. It is to be noted that in addition to these, drive sections and the like for the image forming apparatus 2 are connected to the controller 35. Also, the controller 35 controls the various devices in accordance with the control program and control data written in the memory section 38.

In addition, the stack amount estimation section 58 is connected to the controller 35. The stack amount estimation section 58 detects the projected number of sheets of paper needed for the next image forming job from the number of pages of data or the registered job information and estimates whether all of the paper to be used in the image forming job or the copy set can be stacked in the prescribed stacker when paper is stacked for image formation of the image forming job or copy set in a prescribed stacker.

The "image forming job" herein indicates the set of operations relating to image formation such as print output, and when a document with a plurality of sheets is copied for example, the set of operations for copying the plurality of sheets is one job, and when a plurality of copy sets is being made, the set of operations for the plurality of copy sets is one job. "Copy set" refers to a set of copy (or asset of print) in case of printing a set of contents in an image forming job. That is to say, one image forming job may includes a plurality of copy sets (or print sets).

The controller 35 controls the 1st switching section 52A and the 2nd switching section 52B via the main-body serial communication section 39. For example, the 1st switching section 52A is switched for every image forming job or the copy set, and transport of the paper P is switched from the 1st stacker 40A to the 2nd stacker 40B, and as described below, the 1st switching section 52A performs switching such that if necessary, transporting of the paper P on which recording is done in the next image forming job or the next copy set is switched based on the estimation results from the stack amount estimation section 58. It is to be noted that in the case where three stackers are used consecutively switching of the 2nd switching section 52A is also done.

It is to be noted that in this embodiment is an electrophotographic type image forming apparatus is used the example of the image forming apparatus 2, but any image forming apparatus in which recording can be done on the paper P may be used, and examples of image recording apparatuses other than the electrophotographic type include a thermal printer or inkjet printer and the like. Furthermore, the image forming apparatus 2 may be a printer, copier, facsimile or a combination of these devices.

The 1st stacker 40A will be described in the following.

As shown in FIG. 1, the 1st main stacker 41A for stacking paper P is provided inside the 1st stacker 40A. 1st main stacker 41A has a 1st elevator section 42A which can move up and down, and the 1st elevator section 42A is positioned at the uppermost part when paper P is not stacked thereon and moves down when paper P is stacked and then up again when the stacked paper P is removed. Control of the up and down movement of the 1st elevator section 42A is done by providing a detection means (not shown) in the vicinity of the uppermost portion, and when paper P is detected by the detecting means, the 1st elevator section 42A is moved down by a predetermined distance. Alternatively, the 1st elevator section 42A may be controlled to move down until paper P cannot be detected by the detection means. Each time paper P is detected, the down movement is repeated, and when the paper P is taken off, it moves up. The 1st elevator section 42A has a 1st retention mechanism 42A for retaining and transporting the paper P to the 1st elevator section 42A (See FIG. 2). Also, 1st elevator section 42A includes: a 1st no-paper detector 44A for detecting the presence of paper P; a 1st full detector 46A for detecting the full state as a prescribed amount; and a 1st pre-full detector 45A which is a prescribed amount detector which detects a near full state in which the preset amount is a fixed amount less than the prescribed value.

Figure 3:
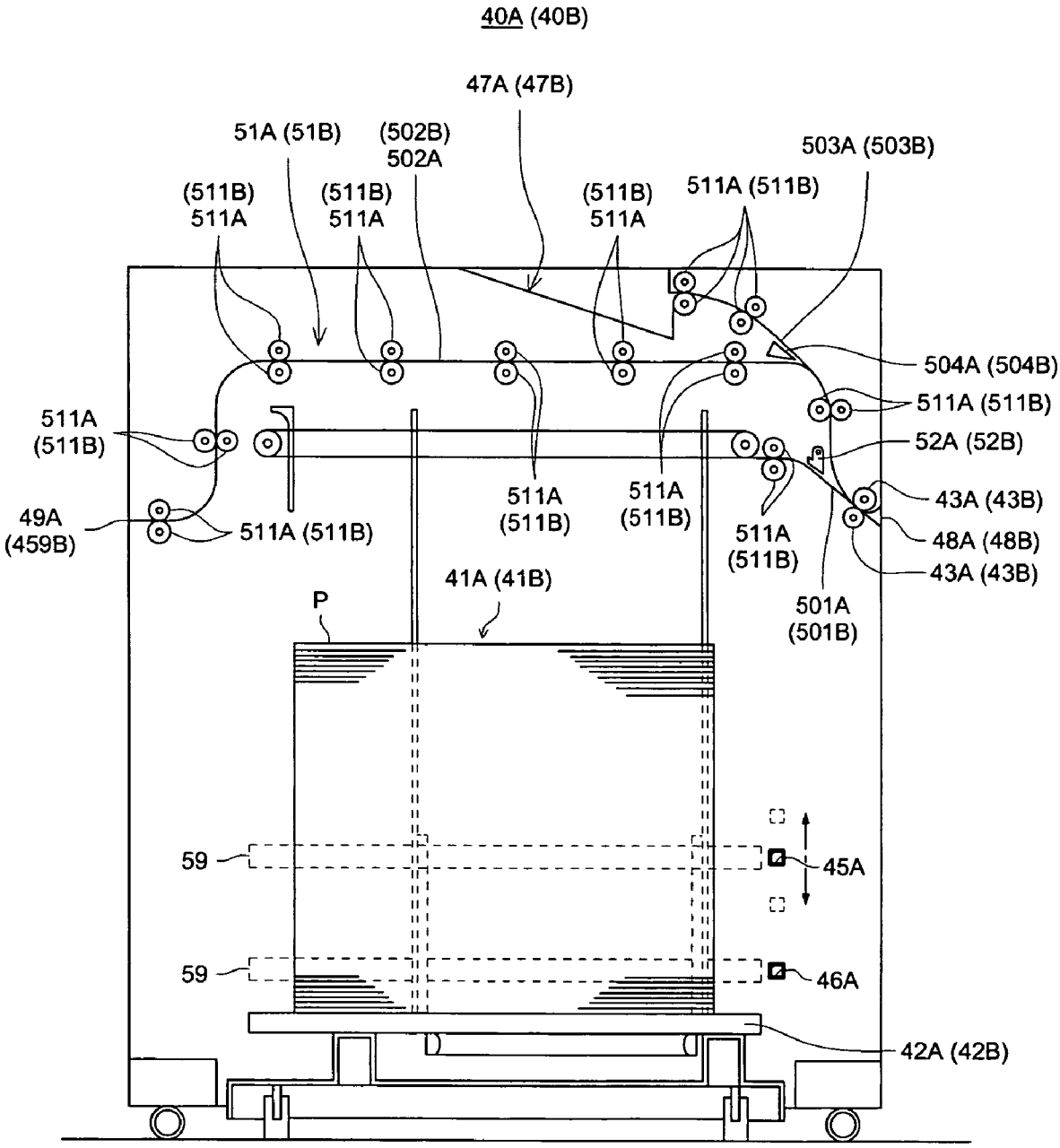
FIG. 3 is pattern diagram showing the main parts of the 1st full detector and the 1st pre-full detector.
Figure 4:
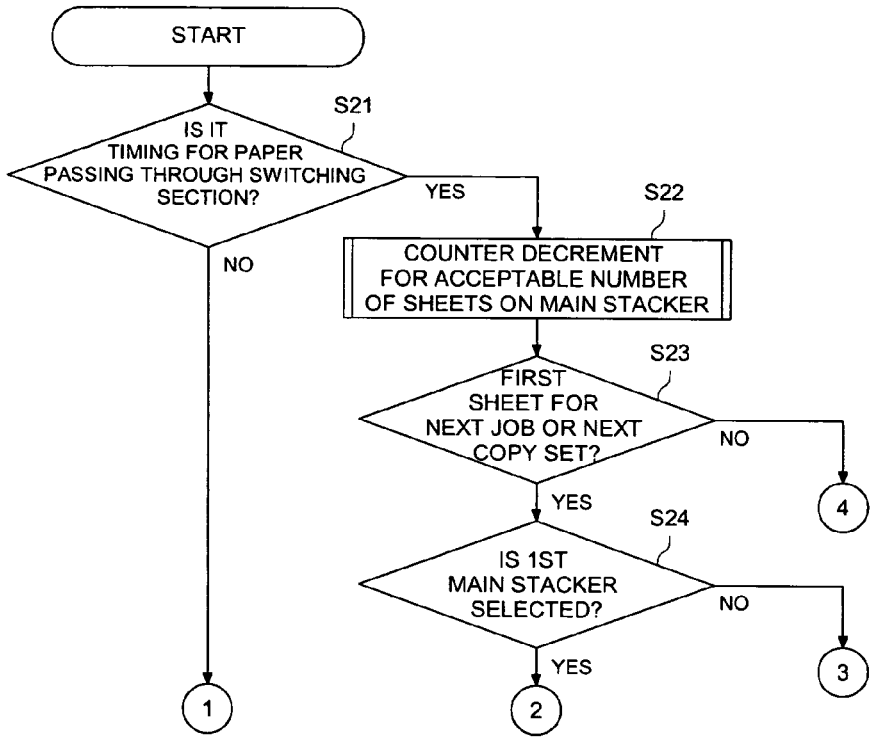
FIG. 4 is a flowchart for describing a specific example of the control operation in the image forming system.

More specifically, as shown in FIG. 3, the 1st elevator section 42A has a paper mounting table 59 which is supported such that it can move up and down. A 1st full detector 46A is provided at substantially the lowermost level on the track in the elevation direction of the paper mounting table 59, and the 1st pre-full detector 45A is provided toward the lowermost level. Paper P on which image formation has been performed and which has been transported is placed on the paper mounting table 59, and when the paper mounting table 59 moves downward and passes by the side of the 1st pre-full detector 45A, a detection is made that the preset amount for pre-full has been reached. Furthermore, when the paper mounting table 59 moves downward to the lowermost level, it is detected that full has been reached.

It is to be noted that the preset amount pre-full just before the full amount, in the case where the full amount is 5000, may be set to be 4000 which is 1000 sheets before the full amount. In this manner, by doing an estimation when the near full state is detected, if the there is a 10% variation due to thickness and load state, there is a 500 sheet error when stack space estimation is done for 5000 sheets which is the full amount, but when stack space estimation is done for 1000 sheets, the error is limited to 100 sheets.

Furthermore, the position of the 1st pre-full detector 45A may be changed. By changing the position, the pre-full preset value may be varied. For example, the setting may be done in accordance with objective, and when recording for an image forming job is performed, the pre-full set value may be 1000 sheets before the full amount and for a recording a copy set, the pre-full set value may be 250 before the full amount.

Also, rather than the number of sheets of the paper P, the full or near full state can be detected by the lowering amount (or the cumulative lowering amount) of the elevating type mounting table, and thus it becomes possible to detect the full or near-full state regardless of differences in type or thickness of the paper P.

A 1st sub stacker 47A which stacks paper P transported from outside the device is provided above the 1st stacker 40A. Also, a 1st transport entrance 48A which transports in paper P is provided at one side of the 1st stacker 40A so as to be connected to the transport exit 31 of the image forming apparatus 2, and 1st transport exit 49A for transporting out paper P is provided at the other side. In addition, inside the 1st stacker 40A are: a 1st stacking path 501A for transporting paper P from the 1st transport entrance 48A to the 1st main stacker 41A; a 1st transport exit path 502A which branches from the 1st stacking path 501A and is for transporting paper P to the 1st transport exit 49A; and a 1st sub-path 503A which branches from the 1st transport exit path 502A and is for transporting paper P to the 1st sub stacker 47A. The branch of this 1st sub-path 503A has a switching section 504A for switching the transporting destination to the transport exit 49A or the 1st sub stacker 47A.

The part of the 1st transport exit path 502A that branches from the 1st stacking path 501A has a 1st switching section 52A that performs switching such that the paper P is transported on the 1st stacking path or on the 1st transporting path 502A. The switching section 52A further performs switching of the paper P transportation to either one of a plurality of stackers, and in this example it performs switching to the 1st stacker or to the 2nd stacker, which will be described hereafter. The part of the path that branches from 1st transport entrance 48A to 1st transport exit path 502A on the 1st stacking path 501A and the common transporting path of the image forming apparatus 1 function as the common transporting path in this invention. Also, the 1st stacking path 501A, the 1st transport exit path 502A, and the 1st sub-path 503A have a 1st transport section 51A which transports paper P using the plurality of rollers 511A.

The 1st retention mechanism 43A for retaining and feeding paper P is provided between the 1st switching section 52A on the 1st stacking path 501A and the 1st transport entrance 48A. The 1st retention mechanism 43A is formed from a pair of rollers and feeding of the paper P stops when rotation of the roller stops, and the paper P is thereby retained. The 1st retention mechanism 43A herein may retain at least more than one sheets of paper P in an overlapped state, and if the rollers are driven, the overlapped papers P are fed. It is to be noted that in this embodiment, the 1st retention mechanism 43A is disposed on the 1st stacking path 501A, but it may also be disposed on the common transporting path 32 for example.

As shown in FIG. 2, the 1st stacker 40A has a 1st operation section 53A which operates the 1st stacker 40A. The 1st operation section 53A may be a touch panel for example comprising an input section 531A for inputting various commands and a display section 532A for displaying image forming conditions such as the number of sheets paper size for image formation and the content various commands and the like.

The 1st stacker 40A has a 1st controller 54A for controlling the driving of the drive sections. The 1st switching section 52A; 1st transporting section 51A; 1st sub stacker 47A; 1st input section 531A; 1st display section 532A; 1st elevator section 42A; 1st retention mechanism 43A; 1st no-paper detector 44A; 1st pre-full detector 45A; 1st full detector 46A; 1st counter 55A which includes the counter which counts the number of sheets of paper P stacked and the pre-counter which counts the number of sheets stacked after pre-set amount detection; serial communication sections 56A and 57A which are connected to the image forming apparatus 2 and the 2nd stacker 40B; and a 1st front door locking section 60A for setting or releasing the lock at the paper pickup exit of the 1st main stacker 41A are electrically connected to the 1st stacker 40A.

The 1st controller 54A also has driving sections for the 1st stacker 40A connected thereto. In addition the 1st controller 54A controls each of the parts in accordance with control from the controller 35 of the image forming apparatus 2.

In the case where the 1st controller 54A operates the 1st pre-full detector 45A, the stack amount of paper P is counted until the stack amount exceeds the preset amount for pre-full. When this amount is exceeded the 1st counter 55A is reset and counting is performed from the preset amount. Furthermore after the 1st controller 54A releases paper stacking to the main stacker 41A by switch control of the 1st switching section 52A, the lock for the 1st front door locking section 60A is released and the paper pickup exit is opened.

Next the 2nd stacker 40B will be described. It is to be noted that the 2nd stacker 40B is a similar device to the 1st stacker 40A and for those parts which are the same as those of 1st stacker 40A, 1st in the name will be replaced by 2nd and A in the numbers will be replaced by B, and detailed descriptions thereof will be omitted.

The 2nd transport entrance 48B of the 2nd stacker 40B is connected to the 1st transport exit 49A of the 1st stacker 40A. As a result the 1st transport exit path 502A of the 1st stacker 40A and the 2nd stacking path 501A of the 2nd stacker 40B are connected. That is to say in this invention, the 1st transporting path is formed from the 1st stacking path 501A, and the 2nd transporting path is formed from the 1st transport exit path 502A and the 2nd stacking path 501B. Consequently paper P that has been stacked in the 2nd main stacker 41B of the 2nd stacker 40B is passed from paper containers 21 and 22 of the image forming apparatus 2 and from the image formation section 29 on the 2nd transporting path and thereby transported via the 1st stacker 40A.

Also in the present embodiment, two stackers which are the 1st stacker 40A and the 2nd stacker 40B are serially disposed, and thus there are no connections to the transport exit 49B or the 2nd serial communication section 57B of the 2nd stacker 40B. However if there is a third stacker, a transport entrance and a serial communication section for the third stacker will be connected to the transport exit 49B and 2nd serial communication section 57B.

Next the effects of the image forming system 1 will be described.

When an image formation command is input in the operating section 34 of the image forming apparatus 2, the controller 35 selects the papers container 21 and 22 for which the presence detection section 25 detects paper and the feeding section 23 and 24 of the paper containers 21 and 22 and the transporting section 331 are controlled so as to take the feed transporting path 231 and paper P is transported to the image formation section 29. If at this point image formation has been inputted at the operation section 34 for a plurality of papers P then the controller 35 continuously transports the plurality of sheets with a prescribed timing. The interval of the timing of the each paper P at the time of continuous transportation is called transport timing interval.

When paper P is transported to the image forming section 29, the controller 35 controls the image forming section 29 such that the surface of the photoreceptor drum 291 is evenly charged by the charger 292, and image exposure is performed by the exposure section 293 and electrostatic latent image is formed based on the image data read by the image reading section 3. This electrostatic latent image is developed by the developing section 294 and a toner image is thereby formed.

The controller 35 transports the paper P with a timing such that that the paper P is transported below the photoreceptor drum 291 when the toner image passes above the transporting path and the toner image is transferred to the paper P by the transfer section 295 and also fixed by the fixing section 296. The controller 35 causes the paper P on which image formation has been performed to take the common transporting path 32 and discharges the paper P from the transport exit 31. Subsequently the toner remaining on the surface of the photoreceptor drum 291 is cleaned by the cleaning section 297 to thereby prepare for the next image formation.

When the paper P takes the common transporting path 32 and reaches the transport exit 31 and then enters the transport entrance 48A of the 1st stacker 40A, the controller 35 sends a transport start command to the 1st controller 54A. This transport start command includes selecting the transporting destination for paper P from among: a 1st main stacker 41A; 1st sub stacker 47A; and a 2nd main stacker 41B. In the case where the 2nd main stacker 41B or 2nd sub stacker 47B is selected as the transporting destination, the controller 35 gives a transport start command to the 1st controller 54A and also to 2nd controller 54B.

The following describes the case where each of the transporting destinations is selected.

Firstly if the 1st main stacker 41A is selected, the 1st controller 54A controls the 1st switching section 52A and the 1st transporting section 51A and switches the transporting destination to the 1st main stacker 41A and then transports paper P that entered from the transport entrance 48A. As a result paper P takes the common transporting path 32 and is transported to the 1st main stacker 41A. When transporting is complete the 1st controller 54A increases the value at the 1st counter 55A by 1.

In the case where the 1st sub stacker 47A is selected, the 1st controller 54A controls the 1st switching section 52A, the 1st switching section 504A and the 1st transporting section 51A, such that the transporting destination is switched to the 1st sub stacker 47A and then paper P that entered from the transport entrance 48A is transported. As a result after the paper P reaches the 1st transport exit path 502A from the 1st stacking path 501A, it enters the 1st sub-path 503A and is transported to the 1st sub stacker 47A.

In the case where the 2nd main stacker 41B is selected, the 1st controller 54A controls the 1st switching section 52A and the 1st transporting section 51A such that the transporting destination is switched to the 1st transport exit 49A, and then the paper P that entered from the transport entrance 48A is transported. When the paper P reaches the transport exit 49A and enters the transport entrance 48B of the 2nd stacker 40B, the 2nd controller 54B controls the 2nd switching section 52B and the 2nd transporting section 51B such that the transporting destination is switched to the 2nd main stacker 41B and then the paper P entered from the transport entrance 48B is transported. As a result the paper P takes the 2nd transporting path and is transported to the 2nd main stacker 41B. When the transporting is complete the 2nd controller 54B increases the value at the 2nd counter 55B by 1.

In the case where the 2nd sub stacker 47B is selected the 1st controller 54A controls the 1st switching section 52A and the 1st transporting section 51A such that the transporting destination is switched to the 1st transport exit 49A and then the paper P that entered from the transport entrance 48A is transported. When the paper P reaches the transport exit 49A and enters the transport entrance 48B of the 2nd stacker 40B, the 2nd controller 54B controls the 2nd switching section 52B, 2nd switching section 504B and the 2nd transporting section 51B such that the transporting destination is switched to the 2nd sub stacker 47B and then the paper P that entered from the transport entrance 48B is transported. As a result the paper P reaches the 1st transport exit path 502A from the 1st stacking path 501A and enters the 2nd stacking path 501B. Then after the paper P arrives at the 2nd transport exit path 502B from the 2nd stacking path 501B, the paper P enters the 2nd sub path 503B and is transported to the 2nd sub stacker 47B.

Switching of the transporting destination for paper on which recording has been performed, based on the estimation results at the stack amount estimation section 58 will be described.

Next, an example in which the switch control is performed at the 1st stacker 40A and the 2nd stacker 40B will be described using FIG. 4 to FIG. 8 as the first specific example of control of the image forming system 1.

Figure 5:
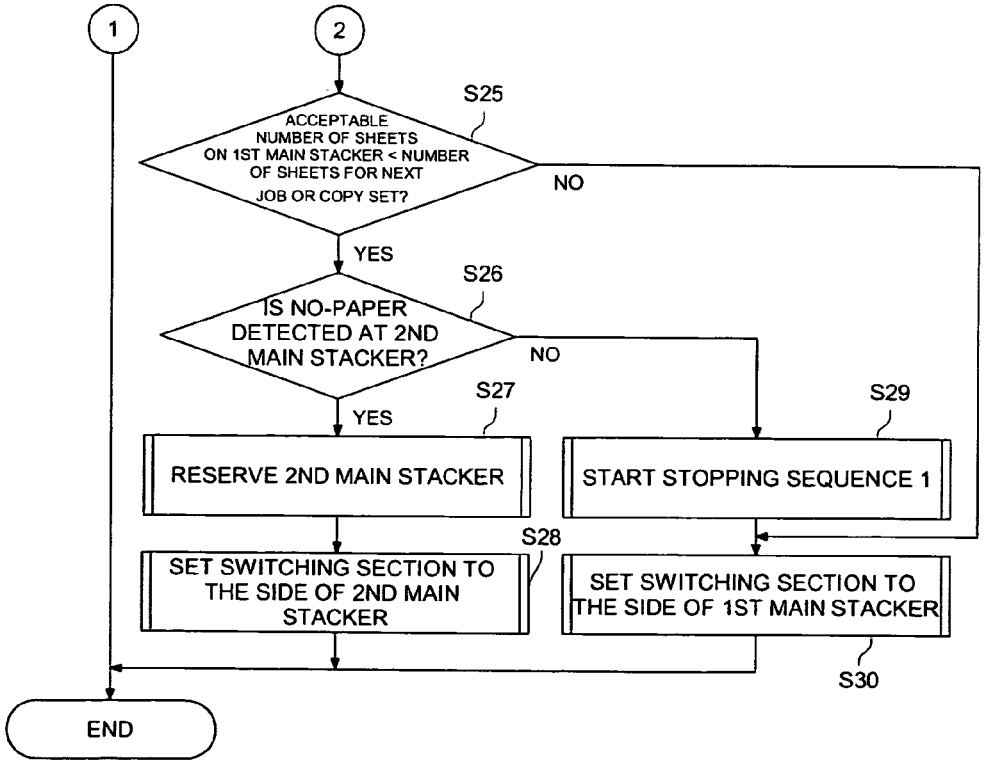
FIG. 5 is a flowchart for describing a specific example of the control operation in the image forming system.

First, in FIG. 1, a determination is made at the 1st controller 54A as to whether the paper has reached the 1st switching section 52A and if it is timing for paper to pass through the 1st switching section 52A (Step S21). If the determination result is NO, or in other words the paper has not reached the 1st switching section 52A or if it is not timing the paper to pass, the control operation ends as shown in FIG. 5.

If the determination result is YES in Step S21, or in other words, if it is determined that it is timing for the paper passing the 1st switching section 52A, control is performed at the 1st controller 54A such that the counter value decrement at the 1st counter 55A which counts the number of sheets stacked at the 1st main stacker 41A is 1 (Step S22). When the paper passes the 1st switching section 52A, a determination is made at the 1st controller 54A as to whether the paper that is transported next is the first sheet of the next image forming job or the next copy set (Step S23).

Figure 7:
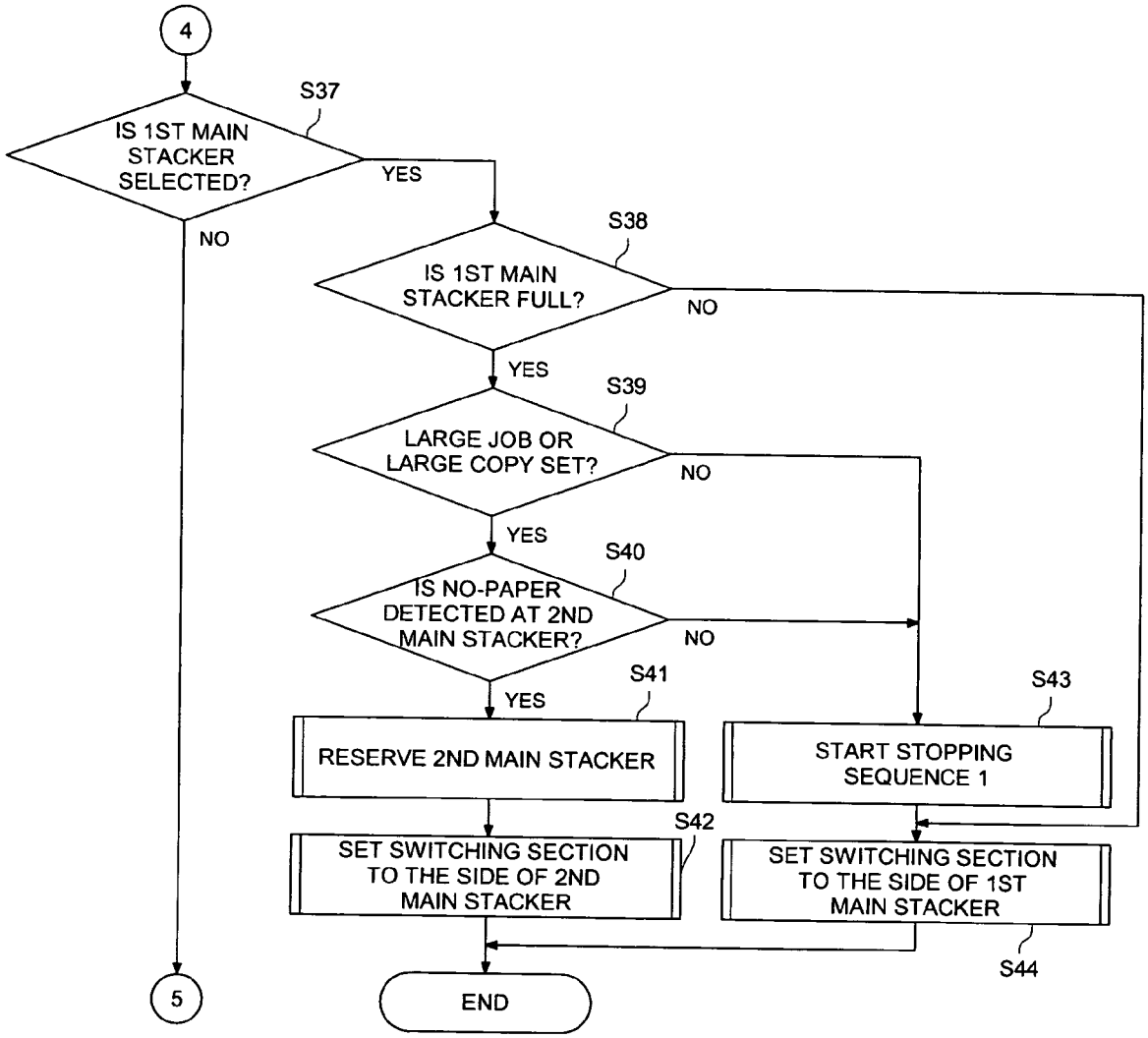
FIG. 7 is a flowchart for describing a specific example of the control operation in the image forming system.

If the determination result is Step S23 is NO, or in other words if it is determined that the sheet to be transported next is not the first sheet of the next image forming job or the next copy set, a determination is made as to whether the 1st main stacker 41A is selected as the transporting destination at the 1st controller 54A as shown in FIG. 7 (Step S37).

If the determination result is Step S23 is YES, or in other words, if it is determined that the sheet to be transported next is the first sheet of the next image forming job or the next copy set, a determination is made as to whether the 1st main stacker 41A is selected as the transporting destination at the 1st controller 54A (Step S24).

Figure 6:
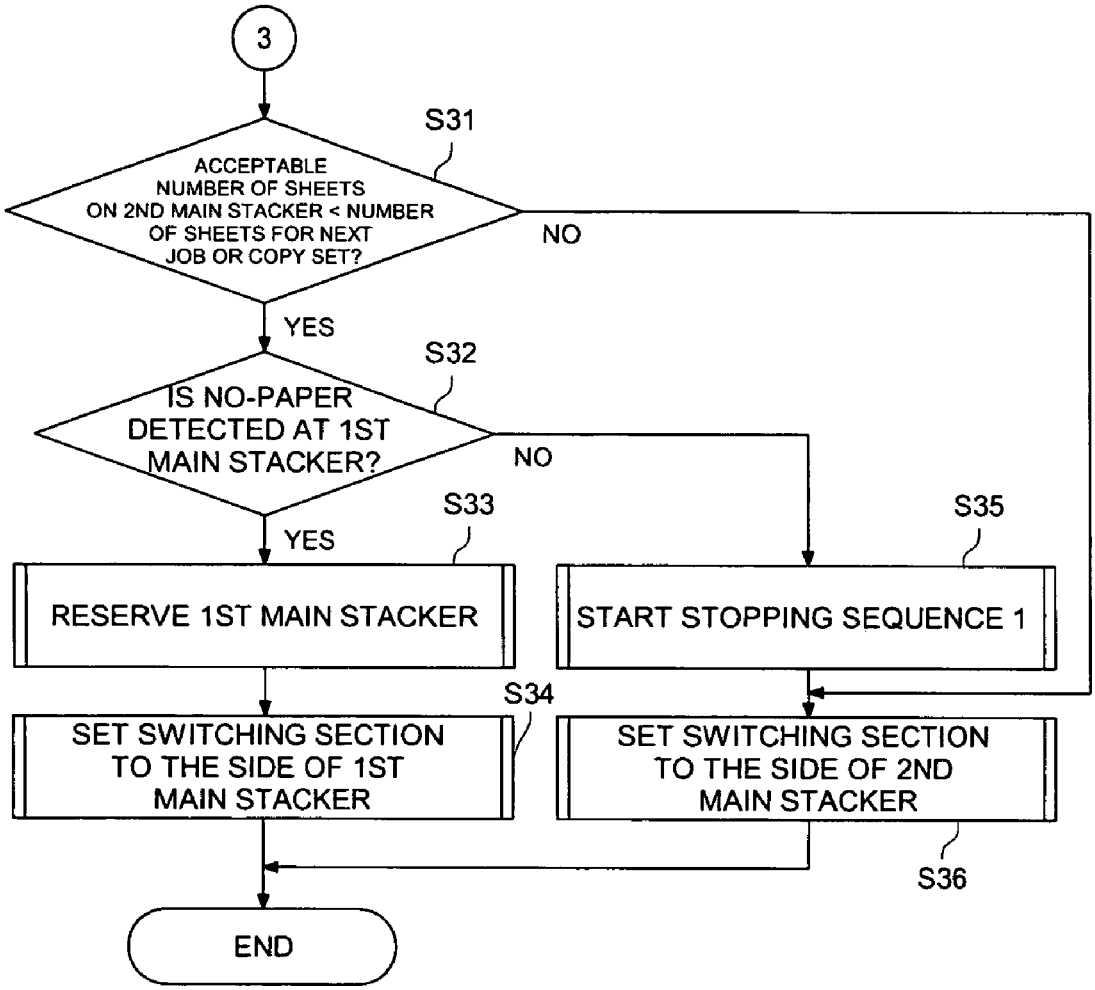
FIG. 6 is a flowchart for describing a specific example of the control operation in the image forming system.

If the determination result in Step S24 is NO, or in other words, if it is determined that the 1st main stacker 41A is not selected as the transporting destination, a determination is made as to whether the acceptable number of sheets at the 2nd main stacker 41B is less than the projected number of sheets for the next image forming job or copy set as shown in FIG. 6 (Step S31). More specifically, the count value itself at the 2nd counter 55B is equivalent to the acceptable number of sheets, and thus a determination is made as to whether this count value is less than the projected number of sheets needed for the next image forming job or copy set.

If the determination result in Step 24 is YES, or in other words, if it is determined that the 1st main stacker 41A is selected as the transporting destination, a determination is made as to whether the acceptable number of sheets at the 1st main stacker 41A is less than the projected number of sheets for the next image forming job or copy set as shown in FIG. 5 (Step S25). More specifically, the count value itself at the 1st counter 55A is equivalent to the acceptable number of sheets, and thus a determination is made as to whether this count value is less than the projected number of sheets needed for the next image forming job or next copy set.

In FIG. 5, if the determination result in Step S25 is NO, or in other words if it is determined that the acceptable number of sheets at the 1st main stacker 41A is not less than the projected number of sheets needed for the next image forming job or next copy set (Step S30), the 1st switching section 52A is controlled to be set to the 1st main stacker 41A side at the 1st controller 54A (Step S30), and the control operation ends.

If the determination result in Step S25 is YES, or in other words if the acceptable number of sheets at the 1st main stacker 41A is less than the projected number of sheets of paper needed for the next image forming job or next copy set, or in other words, when it is determined that all of the paper for the next image forming job or copy set cannot be stacked at the 1st main stacker 41A, the 2nd no-paper detector 44B detects whether the 2nd main stacker 41B is in a no-paper state at the 2nd controller 54B. That is to say, a determination is made as to whether paper on which image formation has been performed is not stacked at the 2nd main stacker 41B (Step S26).

If the determination result in Step S26 is YES, or in other words if paper on which image formation has been performed is not stacked at the 2nd main stacker 41B, 2nd main stacker 41B is reserved such that paper is stacked in therein after image formation is performed in the next image forming job or next copy set (Step S27), and control is performed at the 1st controller 54A and 2nd controller 54B such that the 1st switching section 52A and the 2nd switching section 52B respectively are set to the 2nd main stacker 41B side (Step S28), and the control operation ends.

If the determination result in Step S26 is NO, or in other words if it is determined that paper on which image formation has been performed is already stacked at the 2nd main stacker 41B, control is performed at the controller 35 such that stopping sequence 1 comprising a series of operations for stopping the control operation begins (Step S29), and at the 1st controller 54A such that the 1st switching section 52A is set to the 1st main stacker 41A side (Step S30), and the control operation ends.

The "stopping sequence 1" herein refers to the controller 35 instructing the image formation apparatus 2 to terminate image processing, and also to the series of operations for switching the 1st switching sections 52A and 504A to transport the paper on which image formation has already been performed to a sub stacker (for example 1st sub stacker 47A), when it is determined that all of the paper in the next image forming job or next copy set cannot be stacked in the selected stacker after image formation has been performed, and paper is already stacked in the other stacker, and thus it is determined that further transport of paper cannot be performed. It is to be noted that when image formation is to be performed after the stopping sequence 1, the image formation may be performed from the beginning of the image forming job or may continue from the point of paper that has been discharged in the sub stacker.

In FIG. 6, when a determination is made that the 2nd main stacker 41B has been selected (Step S30 in FIG. 4), or the result is NO in Step S31, or in other words if the acceptable number of sheets at the 2nd main stacker 41B is not less than the projected number of sheets needed for the next image forming job or next copy set, or in other words, when it is determined that after image formation is performed in the next image forming job or next copy set, all of the paper can be stacked in the 2nd main stacker 41B, control is performed at the 1st controller 54A and 2nd controller 54B such that the 1st switching section 52A and the 2nd switching section 52B respectively are set to the 2nd main stacker 41B side (Step S36), and the control operation ends.

If the determination result in Step S31 is YES, or in other words, if the acceptable number of sheets that can be stacked at the 2nd main stacker 41B is less than the projected number of sheets needed for the next image forming job or next copy set, or in other words, when it is determined that all of the paper for the next image forming job or copy set cannot be stacked at the 2nd main stacker 41B, the 1st no-paper detector 44A detects whether the 1st main stacker 41A is in a no-paper state at the 1st controller 54A. That is to say, a determination is made as to whether paper on which image formation has been performed is not stacked at the 1st main stacker 41A (Step S32).

If the determination result in Step S32 is YES, or in other words if it is determined that paper on which image formation has been performed is not stacked at the 1st main stacker 41A, the 2nd main stacker 41B is reserved such that paper is stacked in the 1st main stacker 41A after image formation is performed in the next image forming job or copy set (Step S33), and in 1st controller 54A, control is performed such that the 1st switching section 52A is set to the 1st main stacker 41A side (Step S34), and the control operation ends.

If the determination result in Step S32 is NO, or in other words if it is determined that paper on which image formation has been performed is stacked at the 1st main stacker 41A, the stopping sequence 1 described above which comprises a series of operations for stopping the control operation starts at the controller 35 (Step S35), and control is performed at the 1st controller 54A and the 2nd controller 54B such that the 1st switching section 52A and the 2nd switching section 52B are set to the 2nd main stacker 41B side (Step S36), and the control operation ends.

In FIG. 7, if the paper that passes the 1st switching section 52A is determined to be the first sheet of the next image forming job or next copy set, (Step S23 in FIG. 4), for YES in Step S37, or in other words when it is determined that the 1st main stacker 41A is selected as the transporting destination, a determination is made as to whether the 1st full detector 46A detects that the 1st main stacker 41A is full at the 1st controller 54A (Step S38).

If the determination result in Step S38 is NO, or in other words if it is determined that the 1st main stacker 41A is not yet full, control is performed at the 1st controller 54A such that the 1st switching section 52A is set to the 1st main stacker 41A side (Step S44), and control ends.

If the determination result in Step S38 is YES, or in other words, if it is determined that the 1st main stacker 41A full, a determination is made at the controller 35, as to whether image formation is for an image forming job or copy set that needs a large number of sheets of paper and cannot all be stacked in one stacker (referred to as large job/copy set) is being performed (Step S39).

If the determination result in Step S39 is NO, or in other words, if image formation is not for a large job or copy set, the stopping sequence 1 described above which comprises a series of operations for stopping the control operation starts at the controller 35 (Step S43), and the 1st switching section 52A is controlled so as to be set to the 1st main stacker 41A side at the 1st controller 54A (Step S44), and the control operation ends. The determination result will be NO in Step S39 in the case where the stacker becomes full before the image forming job or copy set is complete, despite the fact that it was determined that the paper is the first sheet of the next job or copy set and can be stacked in Step S23, due to the above-described error.

In addition, if the determination result in Step S39 is YES, or in other words, if image formation is for a large job/copy set, a determination is made as to whether the 2nd no-paper detector 44B detects that there is no paper at the 2nd main stacker 41B at the 2nd controller 54B, or in other words a determination is made as to whether paper on which image formation has been performed is not stacked at the 2nd main stacker 41B (Step S40).

If the determination result in Step S40 is YES, or in other words if it is determined that paper on which image formation has been performed is not stacked at the 2nd main stacker 41B, the 2nd main stacker 41B is reserved such that paper is stacked therein after which image formation is performed in the next image forming job or copy set (Step S41), and control is performed at the 1st controller 54A and 2nd controller 54B such that the 1st switching section 52A and the 2nd switching section 52B respectively are set to the 2nd main stacker 41B side (Step S42), and the control operation ends.

If the determination result in Step S40 is NO, or in other words if it is determined that paper on which image formation has been performed is stacked at the 2nd main stacker 41B, the stopping sequence 1 described above which comprises a series of operations for stopping the control operation starts at the controller 35 (Step S43), and the 1st switching section 52A is controlled at the 1st controller 54A so as to be set to the 1st main stacker 41A side (Step S44), and the control operation ends.

Figure 8:
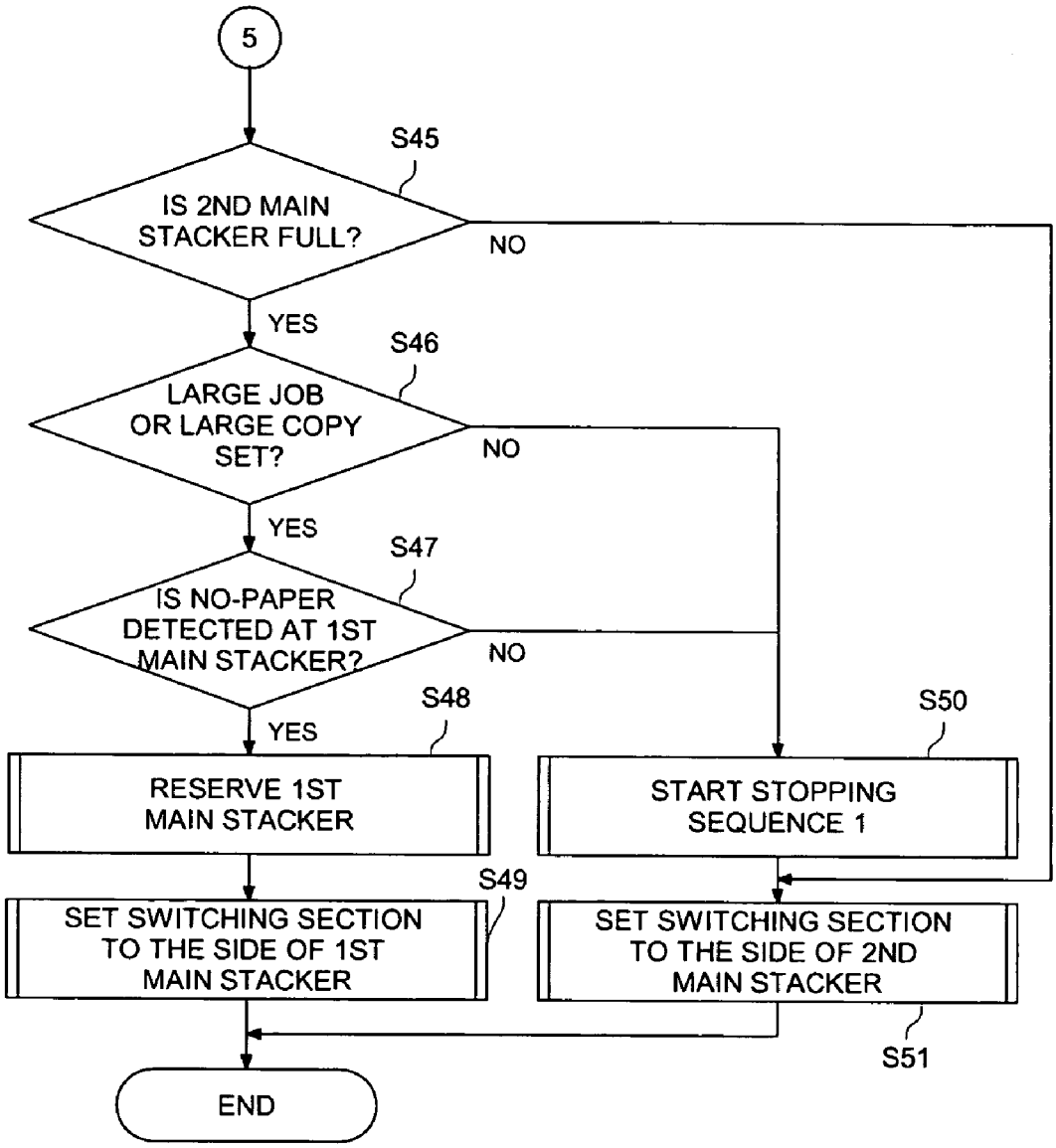
FIG. 8 is a flowchart for describing a specific example of the control operation in the image forming system.

In FIG. 8, if the paper that passes the 1st switching section 52A is determined to be the first sheet of the next image forming job or next copy set, (Step S23 in FIG. 4), for NO in Step S37 of FIG. 7, or in other words when it is determined that the 1st main stacker 41A is not selected as the transporting destination, a determination is made as to whether the 2nd full detector 46B detects that the 2nd main stacker 41B is full at the 2nd controller 54B (Step S45).

If the determination result in Step S45 is NO, or in other words if it is determined that the 2nd main stacker 41B is not yet full, control is performed at the 1st controller 54A and 2nd controller 54B such that the 1st switching section 52A and the 2nd switching section 52B respectively are set to the 2nd main stacker 41B side (Step S51), and the control operation ends.

If the determination result in Step S45 is YES, or in other words, if it is determined that the 2nd main stacker 41B is full, a determination is made at the controller 35, as to whether image formation is for a large job or copy set (Step S46).

If the determination result in Step S46 is NO, or in other words, if image formation is not for a large job/copy set, the stopping sequence 1 described above which comprises a series of operations for stopping the control operation starts at the controller 35 (Step S50), control is performed at the 1st controller 54A and 2nd controller 54B such that the 1st switching section 52A and the 2nd switching section 52B respectively are set to the 2nd main stacker 41B side (Step S51), and the control operation ends. The determination result will be NO in Step S46 in the case where the stacker becomes full before the image forming job or copy set is complete, despite the fact that it was determined that the paper is the first sheet of the next job or copy set and can be stacked in Step S23, due to the above-described error.

Also, if the determination result in Step S46 is YES, or in other words, if image formation is for a large job/copy set, a determination is made as to whether the 1st no-paper detector 44A detects that the 1st main stacker 41A has no paper at the 1st controller 54A, or in other words a determination is made as to whether paper on which image formation has been performed is not stacked at the 1st main stacker 41A (Step S47).

If the determination result in Step S47 is YES, or in other words if it is determined that paper on which image formation has been performed is not stacked at the 1st main stacker 41A, the 1st main stacker 41A is reserved such that paper is stacked therein after image formation is performed in the next image forming job or copy set (Step S48), and control is performed at the 1st controller 54A such that the 1st switching section 52A is set to the 1st main stacker 41A (Step S49), and the control operation ends.

If the determination result in Step S47 is NO, or in other words if it is determined that paper on which image formation has been performed is stacked at the 1st main stacker 41A, the stopping sequence 1 described above which comprises a series of operations for stopping the control operation starts at the controller 35 (Step S50), and control is performed at the 1st controller 54A and 2nd controller 54B such that the 1st switching section 52A and the 2nd switching section 52B respectively are set to the 2nd main stacker 41B side (Step S51), and the control operation ends.

Figure 9:
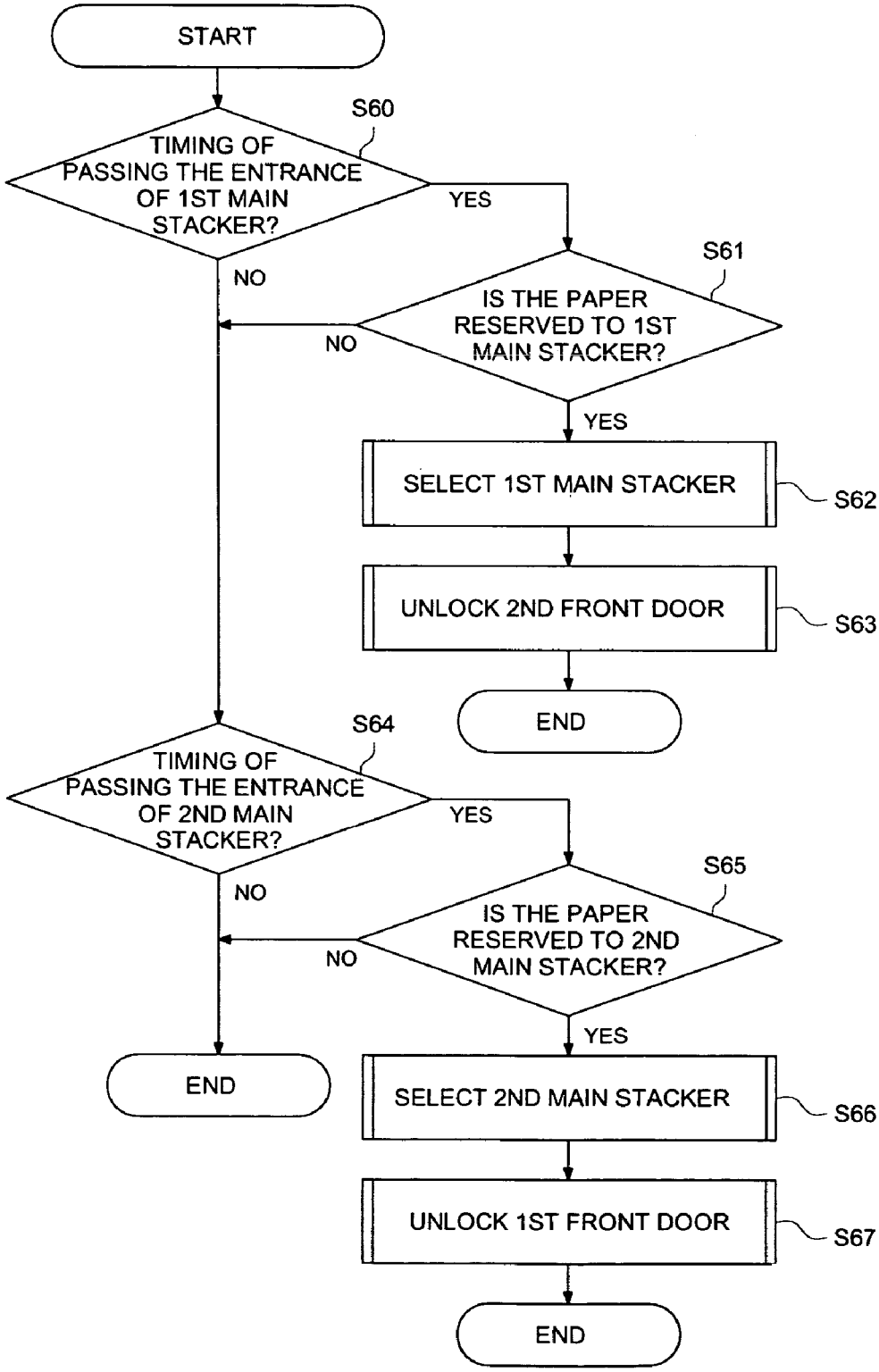
FIG. 9 is a flowchart for describing a specific example of the control operation in the image forming system.

FIG. 9 is a flowchart for describing an example of control after switching of the stacker in Step S28 in FIG. 5, Step S34 in FIG. 6, Step S42 in FIG. 7, and Step S49 in FIG. 8 are performed.

In FIG. 9, a determination is made at the 1st controller 54A as to whether it is timing for the paper to reach and pass the entrance of 1st main stacker 41A (Step S60).

If the determination result in Step S60 is NO, or in other words if the paper has not reached the entrance of the 1st main stacker 41A, or has not reached the 1st switching section 52A, or if it is not the timing for passing the 1st switching section 52A, a determination is made as to whether the paper has reached the entrance of the 2nd stacker 41B and if it timing for the paper to pass (Step S64).

If the determination result in Step S60 is YES, or in other words, if it has been determined that it is the timing for the paper to pass the entrance of the 1st stacker 41A, then a determination is made at the 1st controller 54A as to whether this paper is the 1st sheet of paper (referred to as "1st sheet") when the 1st stacker 41A and the 2nd stacker 41B are switched, and if reservation has been made for the paper to be sent to the 1st stacker 41A (Step S33 in FIG. 6 and Step S48 in FIG. 8) (Step S61).

If the determination result in Step S61 is NO, or in other words, if the paper is not the 1st sheet or if the sheet is not to be sent to the 1st stacker 41A, the paper will be sent to the 2nd stacker 41B, and thus a determination is made as to whether it is the timing for the paper to reach and pass the entrance of the 2nd stacker 41B (Step S64).

If the determination result in Step S61 is YES, or in other words, if the paper is the 1st sheet and if the paper is to be sent to the 1st stacker 41A, the 1st stacker 41A is selected as the transporting destination by the controller 35 (Step S62), while at the 2nd controller 54B, the 2nd front door locking section 60B is released, and the 2nd stacker 41B is opened and the stacked paper may be discharged (Step S63), and the switching operation for the stacker which is the transporting destination for the paper ends.

If the determination result in Step S64 is NO, or in other words if the paper has not reached the entrance of the 2nd stacker 41B, or has not reached the 2nd switching section 52B, or if it is not the timing for the paper to pass, the switching control operations of the transporting destination of the paper ends.

If the determination result in Step S64 is YES, or in other words, if it has been determined that it is the timing for the paper to pass the entrance of the 2nd stacker 41B, then at the 2nd controller 54B, a determination is made as to whether this paper is the 1st sheet of paper, and if a reservation has been made for the paper to be sent to the 2nd stacker 41B (Step S65).

If the determination result in Step S65 is NO, or in other words, if the paper is not the 1st sheet of paper, and the paper is not to be sent to the 2nd main stacker 41B, the switching control operations of the transporting destination of the paper ends.

If the determination result in Step S65 is YES, or in other words, if the paper is the 1st sheet and if the paper is to be sent to the 2nd main stacker 41B, the 2nd main stacker 41B is selected as the transporting destination at the controller 35 (Step S66), while at the 1st controller 54A, the 1st front door locking section 60A is released, and the 1st stacker 41A is opened so that stacked paper may be discharged (Step S67), and the switching operation for the stacker which is the transporting destination for the paper ends.

Figure 10:
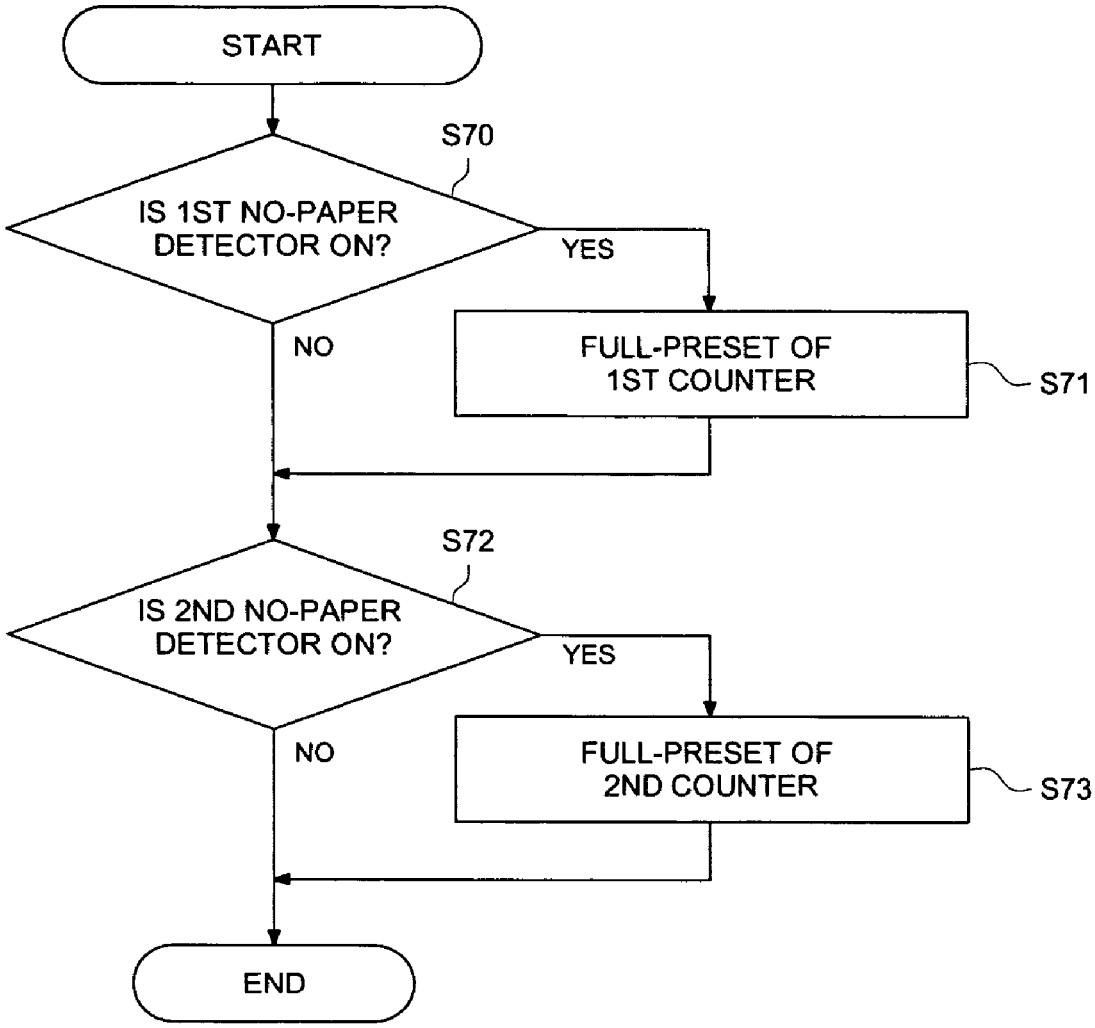
FIG. 10 is a flowchart for describing a specific example of the control operation in the image forming system.

FIG. 10 is a flowchart for describing the counter full preset operation of the 1st counter 55A and the 2nd counter 55B by the 1st controller 54A and the 2nd controller 54B after paper has been taken from the 1st or 2nd main stacker in FIG. 9.

In FIG. 10, a determination is made as to whether the 1st no-paper detector 44A detects a no-paper state at the 1st controller 54A (Step S70). If the determination result in Step S70 is YES, or in other words, the 1st no-paper detector 44A detects a no-paper state, full-preset of the 1st counter 55A is performed by the 1st controller 54A (Step S71), and a determination is made as to whether the 2nd no-paper detector 44B detects a no-paper at the 2nd controller 54B (Step S72). If the determination result in Step S70 is NO, or in other words, the 1st no-paper detector 44A did not detect a no-paper state, a determination is made as to whether the 2nd no-paper detector 44B detected a no-paper at the 2nd controller 54B in the same manner (Step S72).

If the determination result in Step S72 is YES, or in other words, if the 2nd no-paper detector 44B detects a no-paper state, full-preset of the 2nd counter 55B is performed by the 2nd controller 54B (Step 73), and the counter full preset operation ends. If the determination result in Step S72 is NO, or in other words, if the 2nd no-paper detector 44B does not detect a no-paper state, the counter full-preset operation ends.

In both Steps S71 and S72, the counter full-preset value is a number of sheets that can be stacked at each of the main stackers and, may for example, be a count of 5000.

Figure 11:
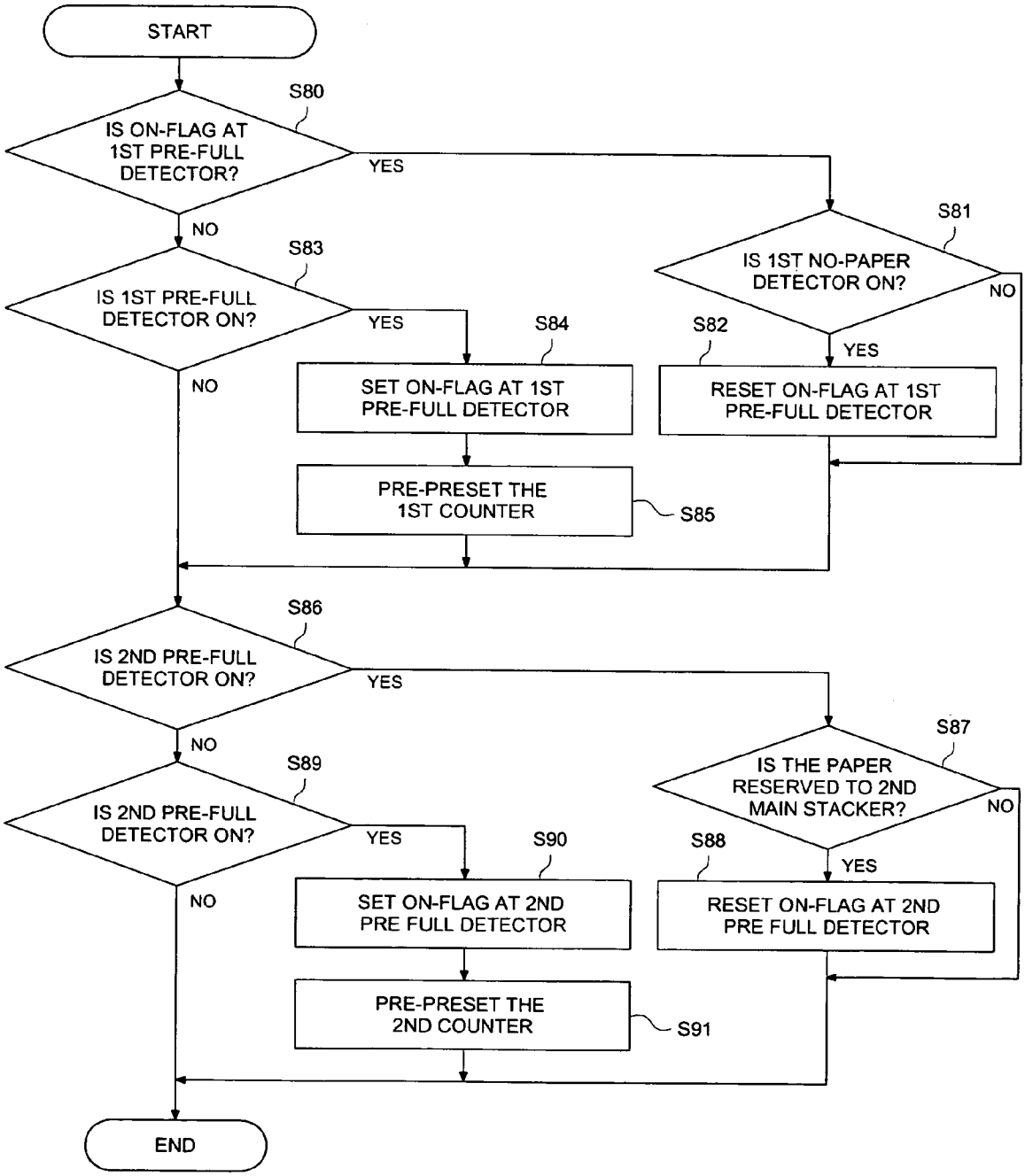
FIG. 11 is a flowchart for describing a specific example of the control operation in the image forming system.

FIG. 11 is a flowchart for describing the counter pre-preset operation of the 1st counter 55A and the 2nd counter 55B by the 1st controller 54A and the 2nd controller 54B when pre-full detection is performed. Pre-full detection herein refers to a state that is close to full as described above, when it is detected that the paper stack amount has reached the preset amount which is a fixed amount less than the prescribed value.

First, a determination is made at the 1st controller 54A as to whether the 1st pre-full detector 45A has detected a pre-full state and if there is a flag to indicate this (Step S80).

If the determination result in Step S80 is YES, or in other words, if there is a flag to indicate pre-full detection at the 1st pre-full detector 45A, a determination is made as to whether the 1st no-paper detector 44A detects that there is no paper in the 1st main stacker 41A at the 1st controller 54A (Step S81). If the determination result in Step S81 is YES, or in other words, if a no-paper detection is made, the 1st pre-full detector 45A flag is reset by the 1st controller 54A (Step S82). If the determination result is NO, or in other words, there is no no-paper detection, no action is taken, and a determination is made as to whether there is a flag indicating that the 2nd pre-full detector 45B has performed pre-full detection at the 1st controller 54A (Step S86).

If the determination result in Step S80 is NO, or in other words, if there is no flag indicating pre-full detection at the 1st pre-full detector 45A, a determination is made as to whether the 1st pre-full detector 45A has performed pre-full detection at the 1st controller 54A (Step S83).

If the determination result in Step S83 is YES, or in other words if pre-full detection is done, pre-full detection flag for the 1st pre-full detector 45A is set by the 1st controller 54A (Step S84), the 1st counter 55A is pre-preset (Step S85), and a determination is made as to whether there is a flag indicating the 2nd pre-full detector 45B has performed pre-full detection at the 2nd controller 54B (Step S86).

If the determination result in Step S83 is NO, or in other words, if pre-full has not been detected, no action is taken and a determination is made as to whether there is a flag indicating the 2nd pre-full detector 45B has performed pre-full detection at the 2nd controller 54B (Step S86).

If the determination result in Step S86 is YES, or in other words, if there is a flag indicating that the 2nd pre-full detector 45B has performed pre-full detection, a determination is made as to whether the 2nd no-paper detector 44B detects that there is no paper in the 2nd main stacker 41B at the 2nd controller 54B (Step S87). If the determination result in Step S87 is YES, or in other words, if no-paper detection is made, the 2nd pre-full detector 45B flag is reset by the 2nd controller 54B (Step S88), and if the determination result is NO, or in other words, if no no-paper detection is made, no action is taken and the 1st counter 55A and 2nd counter 55B are pre-preset.

If the determination result of Step 86 is NO, or in other words, if there is no flag indicating the 2nd pre-full detector 45B has performed pre-full detection, a determination is made as to whether the 2nd pre-full detector 45B has performed pre-full detection at the 2nd controller 54B (Step 89).

If the determination result of Step 89 is YES, or in other words, pre-full detection has been done, the pre-full detection flag of the 2nd pre-full detector 45B is reset by the 2nd controller 54B (Step S90), and the 2nd counter 55B is pre-preset (Step S91), and pre-presetting of theist counter 55A and 2nd counter 55B ends.

If the determination result of Step 89 is NO, or in other words, pre-full is not detected, no action is taken and pre-presetting of theist counter 55A and 2nd counter 55B ends.

The counter pre-set value at steps S85 and S91 may be a count of 1000 when for example it is controlled for the image forming job, and 250 when controlled for a copy set. Furthermore, by setting the mount position of the 1st pre-full detector 45A and the 2nd pre-full detector 45B flag and the counter pre-preset value to be variable, application in various situations is possible.

Figure 12:
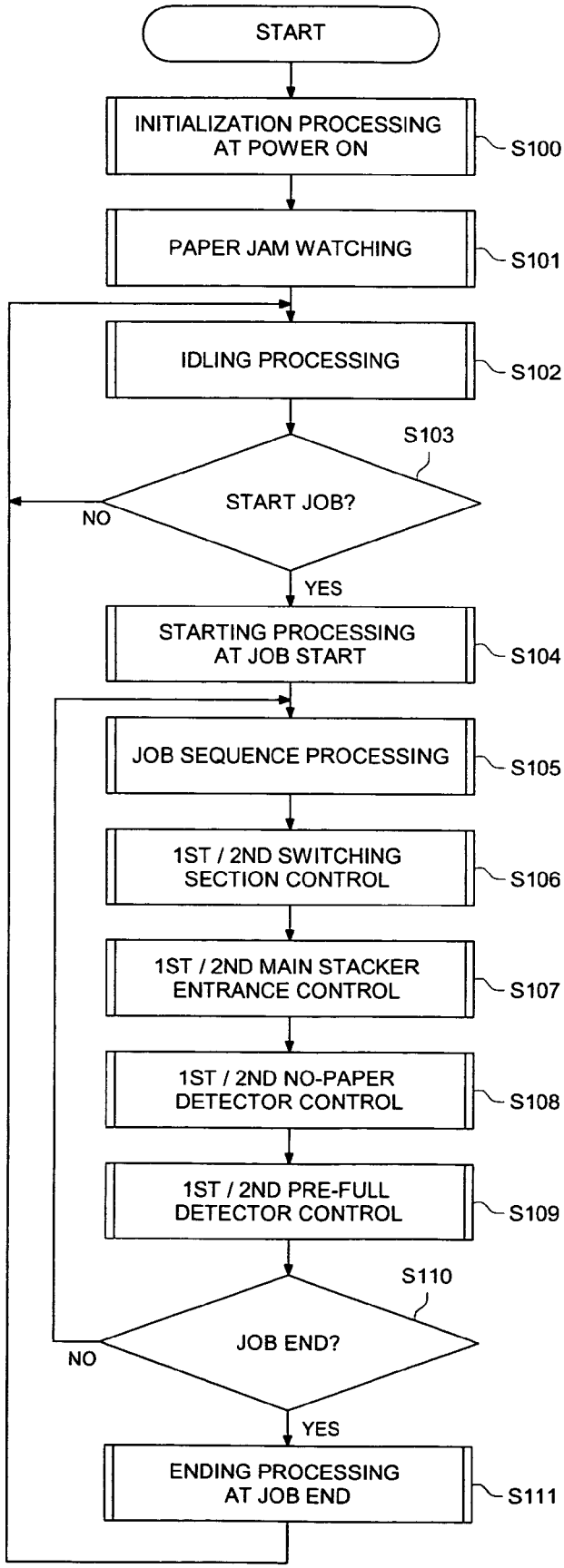
FIG. 12 is a flowchart for describing a specific example of the control operation in the image forming system.

FIG. 12 is flowchart for describing the flow of control operations of the controller 35, the 1st controller 54A, and the 2nd controller 54B from when the power is turned on to the idling processing and the job sequence processing.

When the power is turned on, a prescribed initialization processing is performed (Step S100). Examples of the initialization processing include startup of the CPU in the controllers, clearing of the work memory, and initiating communication between the controllers.

When the initialization processing is complete, standstill/paper job monitoring is performed (Step S101). When it is confirmed that there is no paper jam, processing is done in the waiting for image forming job input state (idling processing) (Step S102).

Next, when the image forming job is input, a determination is made as to whether the job has started (Step S103), and if the determination result is NO, or in other words, if the image forming job has not started, the idling processing continues (Step S102). If the determination result is YES, starting processing for the starting of image forming job is performed (Step S104). Examples of the starting processing include clearing the work memory in the controllers used for the job and initiating communication between the controllers.

After the starting processing (Step S104), the series of processes for performing image formation or the job sequence processes are performed (Step S105). The job sequence processing indicates all processes for performing the job other than the 1st/2nd switching section control, 1st/2nd main stacker entrance control, 1st/2nd no-paper detector control, 1st/2nd pre-full detector control, and detailed descriptions thereof are omitted.

Job sequence processing control (Step S105) of the 1st controller 54A and the 2nd controller 54B (Step S106); job sequence processing control of the 1st main stacker 41A entrance, or in other words, the 1st retention mechanism 43A and the 1st transporting section 51A, and the 2nd main stacker 41B or in other words, 2nd retention mechanism 43B and the 2nd transporting section 51B (Step S107); job sequence processing control of the 1st no-paper detector 44A and the 2nd no-paper detector 44B (Step S108); and job sequence control processing for the 1st pre-full detector 45A and the 2nd pre-full detector 45B (Step S109) are performed in parallel with the job-sequence processing (Step S105). As described in FIG. 12, Step S105 to Step S109 can be processed serially and in this case the order varies.

A determination is made as to whether the image forming job is complete (Step S110), and if the determination result is NO, or in other words, if the image forming job is not complete, job sequence processing (Step S105); job sequence processing control of the 1st controller 54A and the 2nd controller 54B (Step S106); job sequence processing control of the 1st main stacker 41A entrance, or in other words, the 1st retention mechanism 43A and the 1st transporting section 51A, and the 2nd main stacker 41B or in other words, 2nd retention mechanism 43B and the 2nd transporting section 51B (Step S107); job sequence processing control of the 1st no-paper detector 44A and the 2nd no-paper detector (Step S108); and job sequence control processing for the 1st pre-full detector 45A and the 2nd pre-full detector 45B (Step S109) are performed consecutively. If the determination result is YES, or in other words, if the image forming job has ended, the series of process for ending the image forming job or in other words, the ending processing at job end is performed (Step S111), and the process returns to idling processing (Step S102).

Ending processing at job end herein refers to clearing the work memory in the controllers used in idling and initiating communication between the controllers.

Next an example of performing switching control using the image forming apparatus 2, the 1st stacker 40A and the 2nd stacker 40B together, will be described using FIG. 13~FIG. 17 as the second specific example of control of the image forming system 1.

Figure 13:
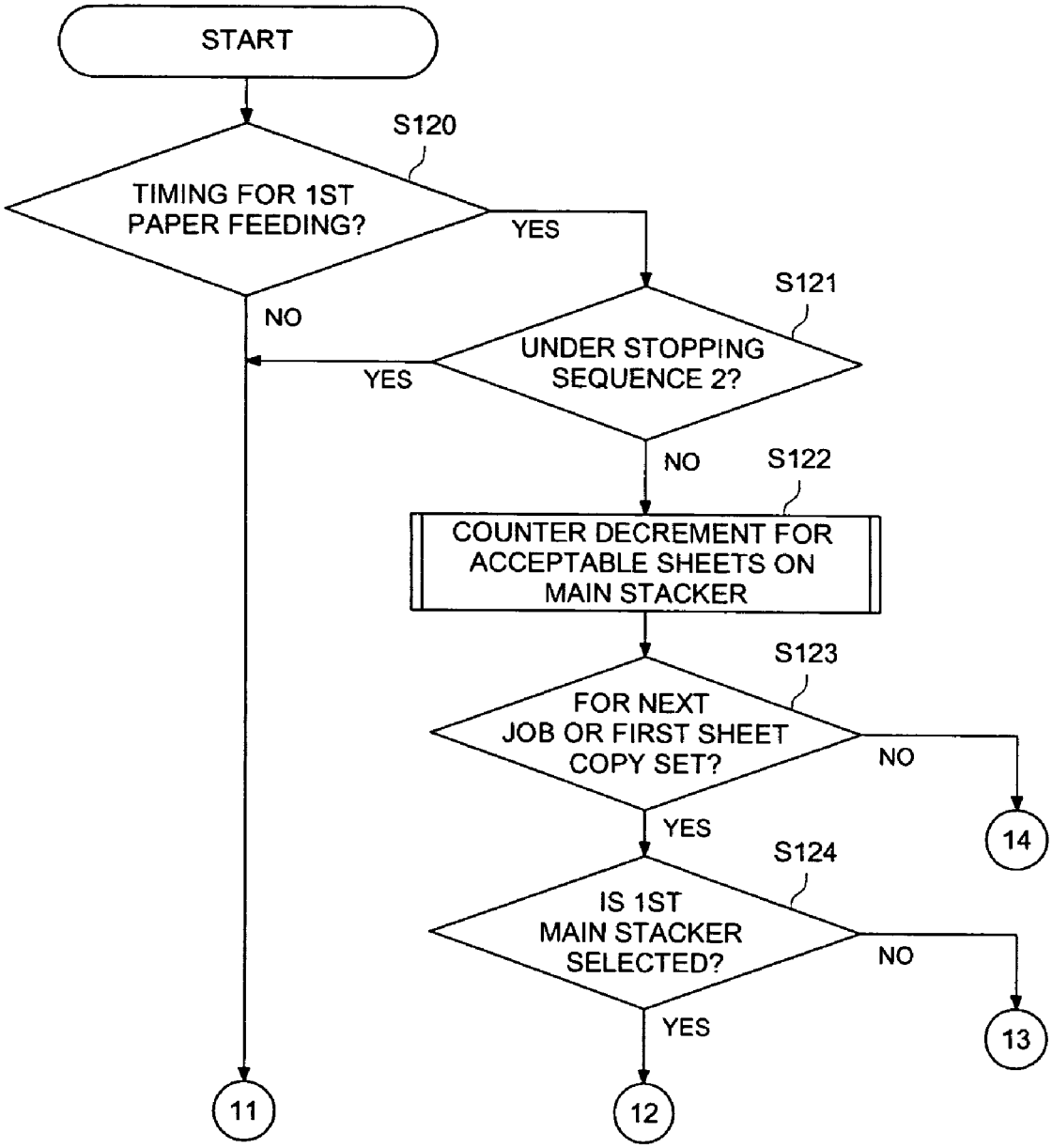
FIG. 13 is a flowchart for describing a specific example of the control operation in the image forming system.
Figure 14:
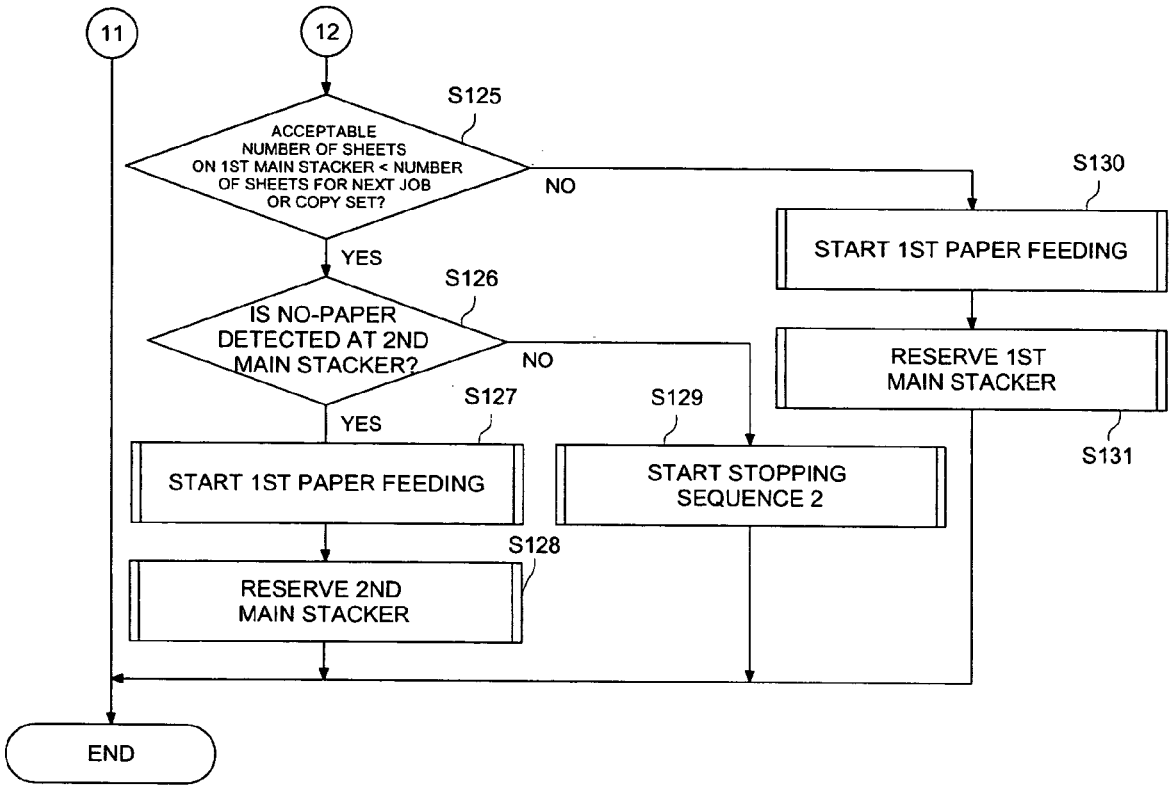
FIG. 14 is a flowchart for describing a specific example of the control operation in the image forming system.

First, in FIG. 13, a determination is made as to whether it is the timing for 1st paper feeding in the paper containers 21 and 22 at the controller 35 of the image forming apparatus 2 (Step S120). If the determination result is NO, or in other words if it is not yet paper feeding timing, the control operation ends as shown in FIG. 14.

The "timing for 1st paper feeding" herein, refers to the timing to start feeding paper from the paper containers 21 and 22.

If the determination result in (Step S120) is yes, or in other words, if it is timing for 1st paper feeding in the image forming apparatus 2, a determination is made as to whether the 1st stacker 40A in the 1st controller 54A (or the 2nd main stacker 41B in the 2nd controller 54B) is in a state for operation of the stopping sequence 2 (Step S121).

If it is determined in this second specific example, that by sending the next paper, the prescribed amount will be exceeded, new paper is not sent and the control operation stops after the end of the series of operations that were in progress (image formation, feeding and stacking of paper fed), therefore, the paper on which image formation has been performed need not be transported to a sub stacker (example, 1st sub stacker 47A). That is, in the stopping sequence 2, the step of switching the 1st switching sections 52A and 504A so that the paper on which is image formation has been performed is transported to the sub stacker of the stopping sequence 1 is omitted.

If the determination result in Step S121 is YES, or in other words if the 1st stacker 40A (or the 2nd stacker 40B) is in a state for operation of the stopping sequence 2, the control operation ends as shown in FIG. 14.

If the determination result in Step S 121 is NO, or in other words if the 1st stacker 40A (or the 2nd stacker 40B) is not in a state for operation of the stopping sequence 2, control is performed at the 1st controller 54A such that the counter value decrement at the 1st counter 55A which counts the number of sheets stacked at the 1st main stacker 41A is 1 (Step S122). Next, a determination is made as to whether the paper timed for 1st paper feeding is the first sheet of the next image forming job or copy set at the controller 35 in the image forming apparatus 2 (Step S123).

Figure 16:
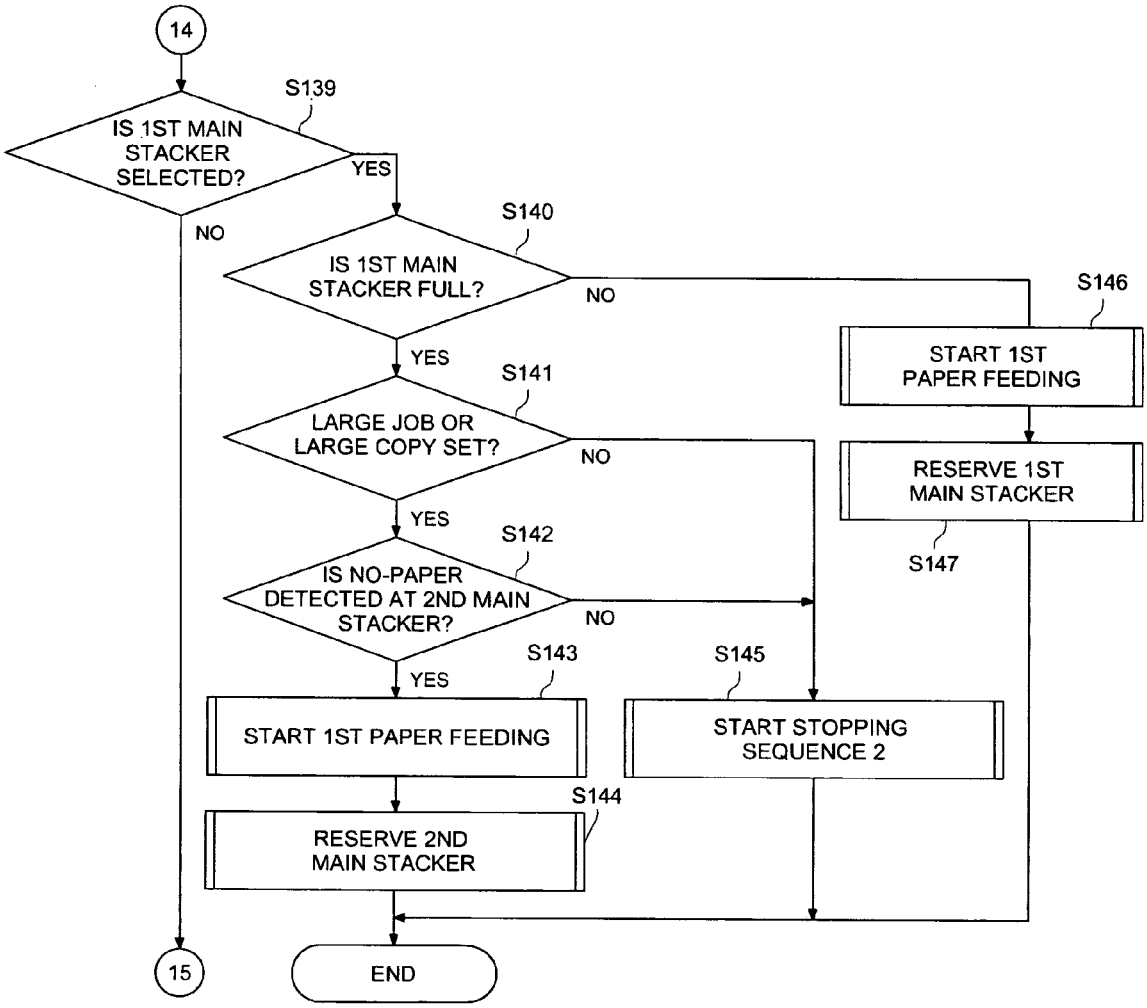
FIG. 16 is a flowchart for describing a specific example of the control operation in the image forming system.

If the determination result in Step S123 is NO, or in other words the paper timed for 1st paper feeding is not the first sheet of the next image forming job or copy set, a determination is made as to whether the 1st main stacker 41A is selected as the transporting destination at the controller 35 as shown in FIG. 16 (Step S139).

If the determination result in Step S123 is YES, or in other words, the paper timed for 1st paper feeding is the first sheet of the next image forming job or copy set, a determination as to whether the 1st main stacker 41A is selected as the transporting destination at the controller 35 (Step S124).

Figure 15:
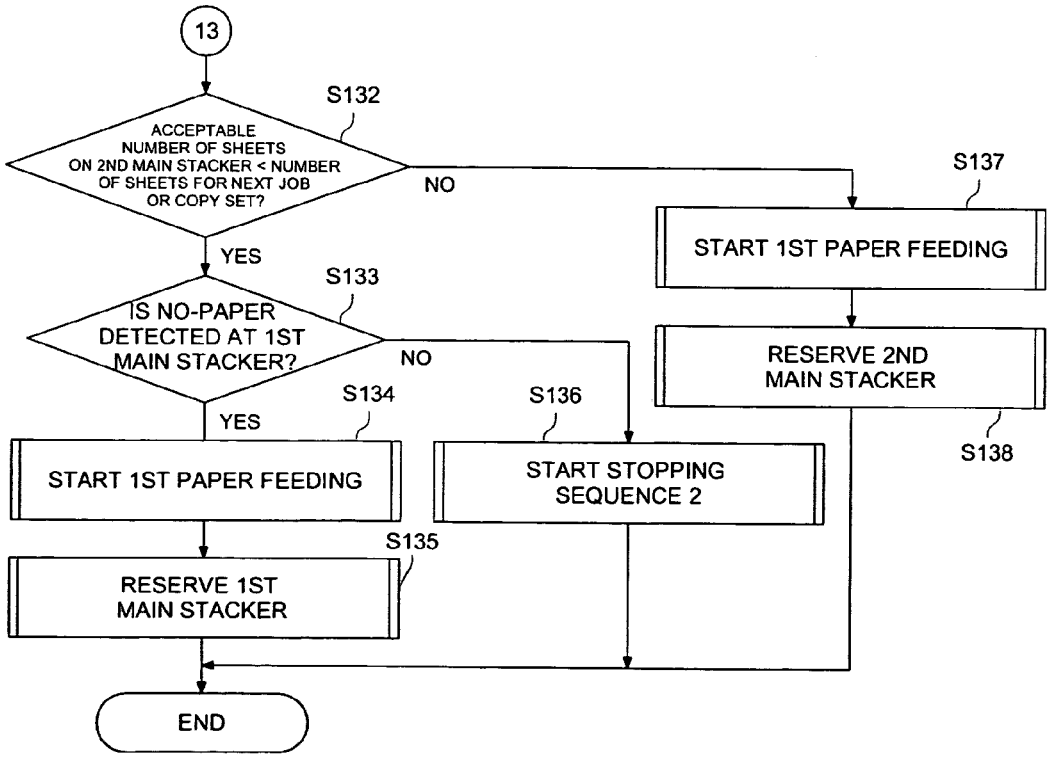
FIG. 15 is a flowchart for describing a specific example of the control operation in the image forming system.

If the determination result in Step 124 is NO, or in other words, if the 1st main stacker 41A is not selected as the transporting destination, a determination is made at the controller 35 as to whether the acceptable number of sheets that can be stacked at the 2nd main stacker 41B is less than the projected number of sheets for the next image forming job or next copy set as shown in FIG. 15, (Step S132). More specifically, the count value of the 2nd counter 55B is sent to the controller 35 from the 2nd controller 54B, and because this count value itself is equivalent to the acceptable number of sheets, a determination is made that the count value is less than the projected number of sheets for the next image forming job or next copy set.

If the determination result in Step 124 is YES, or in other words, if the 1st main stacker 41A is selected as the transporting destination, a determination is made at the controller 35 as to whether the acceptable number of sheets that can be stacked at the 1st main stacker 41A is less than the number of sheets for the next image forming job or next copy set as shown in FIG. 14. (Step S125). More specifically, the count value of the counter 55B is sent to the controller 35 from the 1st controller 54A, and because this count value itself is equivalent to the acceptable number of sheets, a determination is made as to whether the count value is less than the projected number of sheets for the next image forming job or next copy set.

In FIG. 14, if the determination result in Step 125 is NO, or in other words, if the acceptable number of sheets that can be stacked at the 1st main stacker 41A is not less than the projected number of sheets needed for the next image forming job or next copy set, feeding sections 23 and 24 are controlled at the controller 35 and the 1st paper feeding starts (Step S130), and reservation setting is done such that paper is stacked in the 1st main stacker 41A after images are formed thereon in the next image forming job or next copy, and the 1st switching section 52A is controlled to be set at the 1st main stacker 41A side at the 1st controller 54A (Step S131), and the control operation ends.

If the determination result in Step 125 is YES, or in other words, if the acceptable number of sheets that can be stacked at the 1st main stacker 41A is less than the projected number of sheets of paper for the next image forming job or next copy set or in other words, if all of the paper for the next image forming job or next copy set cannot be stacked in the 1st main stacker 41A, a determination is made at the 2nd controller 54B as to whether paper on which image formation has been performed is not stacked in 2nd main stacker 41B (Step S126).

If the determination result in Step S126 is YES, or in other words, if paper on which image formation has been performed is not stacked in 2nd main stacker 41B, feeding sections 23 and 24 are controlled at the controller 35 and the 1st paper feeding starts (Step S127), and reservation setting is done such that the paper is stacked in the 2nd main stacker 41B after images are formed thereon in the next image forming job or next copy, and the 1st switching section 52A and the 2nd switching section 52B respectively are controlled to be set at the 2nd main stacker 41B side at the 1st controller 54A and the 2nd controller 54B (Step S128), and the control operation ends. It is to be noted that the switching operation is performed as shown in FIG. 9 and FIG. 10.

If the determination result in Step 126 is NO, or in other words, if paper on which image formation has been performed is stacked in 2nd main stacker 41B, the above-described stopping sequence 2 begins at the controller 35 (Step S129), and the control operation ends.

In FIG. 15, if it is determined that the 2nd main stacker 41B has been selected (Step S124 in FIG. 13), and the result is NO in Step S132, or in other word if the acceptable number of sheets that can be stacked the 2nd main stacker 41B is not less than the projected number of sheets of paper needed for the next image forming job or next copy set, or in other words if it is determined that all of the paper for the next image forming job or next copy set can be stacked in the 2nd main stacker 41B, feeding sections 23 and 24 are controlled at the controller 35 and the 1st paper feeding starts (Step S137), and reservation setting is done such that paper is stacked in the 2nd main stacker 41B, and the 1st switching section 52A after images are formed thereon in the next image forming job or next copy set, and the 2nd switching section 52B respectively are controlled to be set at the 2nd main stacker 41B side at the 1st controller 54A and the 2nd controller 54B (Step S138), and the control operation ends.

If the determination result in Step S132 is YES, or in other words, if the acceptable number of sheets that can be stacked the 2nd main stacker 41B is less than the projected number of sheets of paper needed for the next image forming job or next copy set or in other words, if all of the paper for the next image forming job or next copy set cannot be stacked in the 2nd main stacker 41B, a determination is made at the 1st controller 54A as to whether the 1st no-paper detector 44A detects a no-paper state at the 1st main stacker 41A, or in other words, a determination is made as to whether paper on which image formation has been performed is not stacked at the 1st main stacker 41A (Step S133).

If the determination result in Step S133 is YES, or in other words, if paper on which image formation has been performed is not stacked at the 1st main stacker 41A, feeding sections 23 and 24 are controlled at the controller 35 and the 1st paper feeding starts (Step S134), and reservation setting is done such that paper is stacked in the 1st main stacker 41A after which image are formed thereon in the next image forming job or next copy set, and the 1st switching section 52A is controlled to be set at the 1st main stacker 41A side at the 1st controller 54A (Step S135), and the control operation ends. It is to be noted that the switching operation is performed as shown in FIG. 9 and FIG. 10.

If the determination result in Step S133 is NO, or in other words, if paper on which image formation has been performed is stacked at the 1st main stacker 41A, the 1st paper feeding of Step S134 and the reservation processes of the 1st stacker in Step S135 are not performed at the controller 35, and the above-described stopping sequence 2 begins (Step S136), and then the control operation ends.

In FIG. 16, if the paper timed for 1st paper feeding is determined not to be the first sheet of the next image forming job or copy set (Step S123 in FIG. 13), and if the result is YES in Step S139, or in other words if it is determined that the 1st main stacker 41A has been selected as the transporting destination, a determination is made as to whether the 1st full detector 46A detects that the 1st main stacker 41A is full at the 1st controller 54A (Step S140).

If the determination result in Step S140 is NO, or in other words, if it is determined the stacker 41A is not yet full, feeding sections 23 and 24 are controlled at the controller 35 and the 1st paper feeding starts (Step S146), and reservation setting is done such that paper is stacked in the 1st main stacker 41A after images are formed thereon in the next image forming job or next copy set, and the 1st switching section 52A is controlled at the 1st controller 54A to be set at the 1st main stacker 41A side (Step S147), and the control operation ends.

If the determination result in Step S140 is YES, or in other words, if it is determined the stacker 41A is full, a determination is made at the controller 35 as to whether image formation for a large job/copy set is being performed (Step S141).

If the determination result in Step S141 is NO, or in other words, if image formation is not for a large job/copy set, the above-described stopping sequence 2 starts at the controller 35 (Step S145), and the control operation ends. The determination result will be NO in Step S141 in the case where the stacker becomes full before the image forming job or copy set is complete, despite the fact that it was determined that the paper is the first sheet of the next job or copy set and can be stacked in Step S123, due to the above-described error.

If the determination result in Step S141 is YES, or in other words, if image formation is for a large job/copy set, a determination is made at the 2nd controller 54B as to whether the 2nd no-paper detector 44B detects that the 2nd main stacker 41B is in a no-paper state, or in other words, a determination is made as to whether paper on which image formation has been performed is not stacked at the 2nd main stacker 41B (Step S142).

If the determination result in Step 142 is YES, or in other words, if paper on which image formation has been performed is not stacked in 2nd main stacker 41B, feeding sections 23 and 24 are controlled at the controller 35 and the 1st paper feeding starts (Step S143), and reservation setting is done such that paper is stacked in the 2nd main stacker 41B after images are formed thereon in the next image forming job or next copy, and 1st switching section 52A and the 2nd switching section 52B respectively are controlled to be set at the 2nd main stacker 41B side in the 1st controller 54A and the 2nd controller 54B (Step S144), and the control operation ends. Stacking as an image forming job unit or copy set unit cannot be done in the large job/copy set mode, but in Step S143 and Step S144 the mode is be switched when the stacker is full. It is to be noted that the switching operation is performed as shown in FIG. 9 and FIG. 10.

If the determination result in Step S142 is NO, or in other words, if it is determined that paper on which image formation has been performed is stacked in 2nd main stacker 41B, the above-described stopping sequence 2 begins at the controller 35 (Step S145), and the control operation ends.

Figure 17:
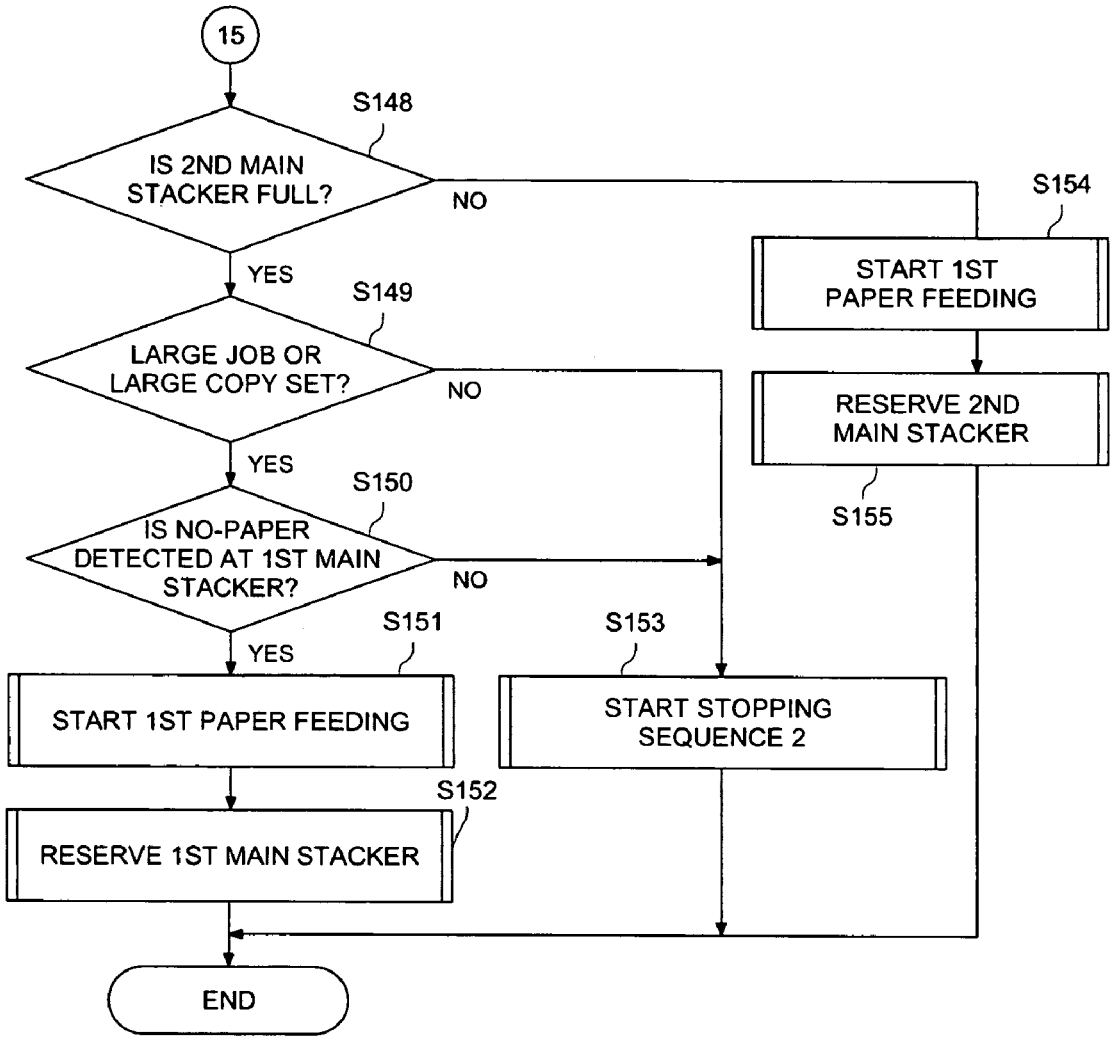
FIG. 17 is a flowchart for describing a specific example of the control operation in the image forming system.

In FIG. 17, a determination is made as to whether the paper timed for 1st paper feeding is the first sheet of the next image forming job or next copy set (Step S123 in FIG. 13), and if the result in Step S139 of FIG. 16 is NO, or in other words if it is determined that the 1st main stacker 41A has been selected as the transporting destination, a determination is made at the 2nd controller 54B as to whether the 2nd full detector 46B detects that the 2nd main stacker 41B is full (Step S148).

If the determination result in Step 148 is NO, or in other words, if it is determined that the 2nd main stacker 41B is not yet full, feeding sections 23 and 24 are controlled at the controller 35 and the 1st paper feeding starts (Step S154), and reservation setting is done such that paper is stacked in the 2nd main stacker 41B after images are formed thereon in the next image forming job or next copy set, and the 1st switching section 52A and the 2nd switching section 52B respectively are controlled to be set at the 2nd main stacker 41B side in the 1st controller 54A and the 2nd controller 54B (Step S155), and the control operation ends.

If the determination result in Step 148 is YES, or in other words, if it is determined that the 2nd main stacker 41B is full, a determination is made at the controller 35 as to whether image formation for a large job/copy set is being performed at the image forming apparatus 2 (Step S149).

If the determination result in Step S149 is NO, or in other words, if image formation is not for a large job/copy set, the above-described stopping sequence 2 begins at the controller 35 (Step S153), and the control operation ends. The determination result will be NO in Step S149 in the case where the stacker becomes full before the image forming job or copy set is complete, despite the fact that, it was determined that the paper is the first sheet of the next job or copy set and can be stacked in Step S123, due to the above-described error.

If the determination result in Step S149 is YES, or in other words, if image formation is for a large job/copy set, a determination is made as to whether the 1st no-paper detector 44A detects that the 1st main stacker 41A is in a no-paper state at the 1st controller 54A, or in other words a determination is made as to whether paper on which image formation has been performed is not stacked at the 1st main stacker 41A (Step S150).

If the determination result in Step S150 is YES, or in other words, if it is determined that paper on which image formation has been performed is not stacked at the 1st main stacker 41A, feeding sections 23 and 24 are controlled at the controller 35 and the 1st paper feeding starts (Step S151), and reservation setting is done such that paper is stacked in the 1st main stacker 41A after images are formed thereon in the next image forming job or next copy set, and the 1st switching section 52A is controlled to be set at the 1st main stacker 41A side in the 1st controller 54A (Step S152), and the control operation ends. Stacking as an image forming job unit or copy set unit cannot be done in the for a large job/copy set mode, but in Step S151 and Step S152 the mode is switched when the stacker is full. It is to be noted that the switching operation is performed as shown in FIG. 9 and FIG. 10.

If the determination result in Step S150 is NO, or in other words, if it is determined that paper on which image formation has been performed is stacked at the 1st main stacker 41A, the 1st paper feeding of Step S151 and the 1st main stack reserving processing of Step S152 are not performed and the above-described stopping sequence 2 starts at the controller 35 (Step S50), and the control operation ends.

According to the above embodiments, even for an image forming job or copy set in which large volume recording is performed, it is possible to ensure that the paper for an image forming job unit or a copy set unit is stacked in the same stacker.

Furthermore, it is possible to estimate beforehand whether the number of sheets of paper needed for the next image forming job or next copy set can be stacked.

In addition, it is possible to further improve the accuracy of the estimation by providing preset amount detectors which are the 1st pre-full detector 45A and the 2nd pre-full detector 45B.

It is to be noted that the present invention is not limited to the above embodiments and various alteration and modifications of the settings can be made without departing from the scope of the present invention.

For example, in this invention, the stacker for stacking the paper on which images have been recorded is a stacking device such as stacker, but the stacker is not limited thereto, and any means for loading paper such as a tray may be used without problem.

What is claimed is:

1. An image forming system comprising:

an image forming section for forming images on sheets of paper;

a transporting path for transporting the sheets of paper on which the images have been formed in the image forming section;

a plurality of stackers for stacking the sheets of paper transported by the transporting path, each stacker of the plurality of stackers being capable of sequentially stacking the paper up to a prescribed amount corresponding to a full capacity of the each stacker;

a switching section for selecting and switching to, on a way of the transporting path, a transporting destination of the paper among the plurality of stackers;

a controller for detecting a projected number of sheets of paper needed for at least one of a next image forming job following a preceding image forming job and a next copy set following a preceding copy set, and for controlling the image forming section and the switching section; and a determination section for determining, in cases where the sheets of paper of at least one of the next image forming job and the next copy set are stacked in one stacker of the plurality of stackers, whether an amount of the sheets of paper to be stacked exceeds the prescribed amount for the one stacker, the amount of the sheets of paper to be stacked being calculated based on the projected number of sheets of paper and an amount of the sheets of paper already having been stacked;

wherein in cases where the determination section has determined that the amount of the sheets of paper to be stacked exceeds the prescribed amount, the controller controls the switching section to switch the transporting destination for the sheets of paper of at least one of the next image forming job and the next copy set to another stacker within the plurality of stackers.

2. The image forming system of claim 1, further comprising:

a counter for counting a number of sheets of paper stacked in the one stacker, wherein the determination section determines whether the sum of a count value at the counter and the projected number of sheets exceeds the prescribed amount for the one stacker.

3. The imaging system of claim 1, wherein the determination section determines whether the amount of the sheets of paper to be stacked exceeds the prescribed amount, during the transportation of papers.

4. The imaging system of claim 1, wherein the determination section determines whether the amount of the sheets of paper to be stacked exceeds the prescribed amount, during a paper feeding.

5. An image forming system comprising:

an image forming section for forming images on sheets of paper;

a transporting path for transporting sheets of paper on which the images have been formed in the image forming section;

a plurality of stackers for stacking the sheets of paper transported by the transporting path, each stacker of the plurality of stackers being capable of sequentially stacking the paper up to a prescribed amount corresponding to a full capacity of the each stacker;

a switching section for selecting and switching to, on a way of the transporting path, a transporting destination of the paper among the plurality of stackers;

a controller for detecting a projected number of sheets of paper needed for at least one of a next image forming job following a preceding image forming job and a next copy set following a preceding copy set, and for controlling the image forming section and the switching section; and a determination section for determining, in cases where the sheets of paper of at least one of the next image forming job and the next copy set are stacked in one stacker of the plurality of stackers, whether an amount of the sheets of paper to be stacked exceeds the prescribed amount for the one stacker;

a pre-set detector for detecting whether a paper stack amount in the one stacker reaches the pre-set amount which is less than the prescribed value by a specific amount;

a pre-counter for counting a number of sheets of paper stacked in the one stacker after the preset detector detected that the paper stack amount reached the pre-set amount; wherein the determination section determines whether a sum of the projected number of sheets of paper detected at the controller and the number of sheets of the paper counted by the pre-counter exceeds a difference between the prescribed amount for the one stacker and the preset amount, wherein in cases where the determination section has determined that the sum exceeds the difference, the controller controls the switching section to switch the transporting destination for the sheets of paper of at least one of the next image forming job and the next copy set to another stacker within the plurality of stackers.

6. An image forming method for carrying out post-processing such that papers on which images have been formed is stacked in a plurality of stackers, each stacker of the plurality of stackers being capable of sequentially stacking the paper up to a prescribed amount corresponding to a full capacity of the each stacker, the image forming method comprising the steps of:

detecting a projected number of sheets of paper needed for at least one of a next image forming job following a preceding image forming job and a next copy set following a preceding copy set;

determining, in cases where the sheets of paper of at least one of the next image forming job and the next copy set are stacked in one stacker of the plurality of stackers, whether an amount of the sheets of paper to be stacked exceeds the prescribed amount that is set for the one stacker, the amount of the sheets of paper to be stacked being calculated based on the projected number of sheets of paper and an amount of the sheets of paper already having been stacked; and switching the destination of the sheets of paper of at least one of the next image forming job and the next copy set to another stacker than the one stacker of the plurality of stackers, when the amount of sheets of paper to be stacked is determined to exceed the prescribed amount for the one stacker;

wherein the step of switching is conducted when transporting of sheets of paper, on which images have been formed, is switched from transportation of the preceding copy set to transportation of the next copy set.

7. The image forming method of claim 6, wherein the step of determining is conducted when the sheets of paper are transported to the one stacker of the plurality of stackers.

8. The imaging forming method of claim 6, wherein the step of determining is conducted when paper, on which an image is to be formed, is being fed.

9. The image forming method of claim 7, further comprising the step of confirming for checking the presence of paper in the other stacker of the plurality of stackers when in the step of determining the amount of sheets of paper to be stacked is determined to exceed the prescribed amount, for reserving a switching of destination by the step of switching if there is no paper in the another stacker and conducting to feed paper on which an image is to be formed, and for stopping at least paper feeding if there is paper in the another stacker.

10. The image forming method of claim 6, wherein in the step of determining the number of sheets of paper stacked in the one stacker is counted, and whether the sum of the number of sheets counted and the projected number of sheets detected exceeds the prescribed amount for the one stacker is determined.

11. The image forming method of claim 7, wherein in the step of determining a number of sheets of paper stacked in the one stacker is counted, and whether the sum of the number of sheets counted and the projected number of sheets detected exceeds the prescribed amount for the one stacker is determined.

12. The image forming method of claim 8, wherein in the step of determining a number of sheets of paper stacked in the one stacker is counted, and whether the sum of the number of sheets counted and the projected number of sheets detected exceeds the prescribed amount for the one stacker is determined.

13. An image forming method for carrying out post-processing such that papers on which images have been formed is stacked in a plurality of stackers, each stacker of the plurality of stackers being capable of sequentially stacking the paper up to a prescribed amount corresponding to a full capacity of the each stacker, the image forming method comprising the steps of:

detecting a projected number of sheets of paper needed for at least one of a next image forming job following a preceding image forming job and a next copy set following a preceding copy set;

determining, in cases where the sheets of paper of at least one of the next image forming job and the next copy set are stacked in one stacker of the plurality of stackers, whether an amount of the sheets of paper to be stacked exceeds the prescribed amount that is set for the one stacker;

detecting pre-set amount for detecting whether a paper stack amount in the one stacker reaches the pre-set amount which is less than the prescribed value by a specific amount;

counting the number of sheets of paper stacked in the one stacker after the step of detecting pre-set amount detected that the paper stack amount reached the pre-set amount; wherein, the step of determining determines whether the sum of the projected number of sheets of paper detected and the number of sheets of the paper counted exceeds the difference between the prescribed amount for the one stacker and the pre-set; and switching the destination of the sheets of paper of at least one of the next image forming job and the next copy set to another stacker than the one stacker of the plurality of stackers, when the sum is determined to exceed the difference, wherein the step of switching is conducted when transporting of sheets of paper, on which images have been formed, is switched from transportation of the preceding copy set to transportation of the next copy set.

14. The image forming method of claim 13, wherein the step of determining is conducted when the sheets of paper are transported to the one stacker of the plurality of stackers.

15. The image forming method of claim 13, wherein the step of determining is conducted when paper, on which an image is to be formed, is being fed.

16. An image forming system comprising:

an image forming section for forming images on sheets of paper;

a transporting path for transporting sheets of paper on which the images have been formed in the image forming section;

a plurality of stackers for stacking the sheets of paper transported by the transporting path, each stacker of the plurality of stackers being capable of sequentially stacking the paper up to a prescribed amount corresponding to a full capacity of the each stacker;

a switching section for selecting and switching to, on a way of the transporting path, a transporting destination of the paper among the plurality of stackers;

a controller for detecting a projected number of sheets of paper needed for a next copy set following a preceding copy set, and for controlling the image forming section and the switching section;

a pre-set detector for detecting whether a paper stack amount in the one stacker reaches the pre-set amount which is less than the prescribed amount;

a counter for counting a number of sheets of paper stacked in the one stacker after the pre-set detector detected that the paper stack amount reached the pre-set amount; and a determination section for determining, in cases where the sheets of paper of the next copy set are stacked in one stacker of the plurality of stackers, whether the projected number of sheets of paper needed for the next copy set exceeds an acceptable number of sheets for the one stacker, the acceptable number of sheets of paper being calculated using the count value by the counter, wherein in cases where the determination section has determined that the projected number of sheets of paper exceeds the acceptable number of sheets, the controller controls the switching section to switch the transporting destination for the sheets of paper of the next copy set to another stacker within the plurality of stackers.

17. An image forming system comprising:

an image forming section for forming images on sheets of paper;

a transporting path for transporting sheets of paper on which the images have been formed in the image forming section;

a plurality of stackers for stacking the sheets of paper transported by the transporting path, each stacker of the plurality of stackers being capable of sequentially stacking the paper up to a prescribed amount corresponding to a full capacity of the each stacker;

a switching section for selecting and switching to, on a way of the transporting path, a transporting destination of the paper among the plurality of stackers;

a controller for detecting a projected number of sheets of paper needed for a next image forming job following a preceding image forming job, and for controlling the image forming section and the switching section;

a pre-set detector for detecting whether a paper stack amount in the one stacker reaches the pre-set amount which is less than the prescribed amount;

a counter for counting a number of sheets of paper stacked in the one stacker after the pre-set detector detected that the paper stack amount reached the pre-set amount; and a determination section for determining, in cases where the sheets of paper of the next image forming job are stacked in one stacker of the plurality of stackers, whether the projected number of sheets of paper needed for the next image farming job exceeds an acceptable number of sheets for the one stacker, the acceptable number of sheets of paper being calculated using the count value by the counter, wherein in cases where the determination section has determined that the projected number of sheets of paper exceeds the acceptable number of sheets, the controller controls the switching section to switch the transporting destination for the sheets of paper of the next image forming job to another stacker within the plurality of stackers.

* * * * *